US008317277B2

(12) United States Patent
Hu et al.

(10) Patent No.: US 8,317,277 B2
(45) Date of Patent: Nov. 27, 2012

(54) DAMPENED ASSISTED-MOTION SYSTEMS AND METHODS

(75) Inventors: Thomas Sheng-Shyong Hu, Corona, CA (US); Saul Gutnik, Irvine, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 299 days.

(21) Appl. No.: 12/763,097

(22) Filed: Apr. 19, 2010

(65) Prior Publication Data

US 2010/0264794 A1 Oct. 21, 2010

Related U.S. Application Data

(60) Provisional application No. 61/237,946, filed on Aug. 28, 2009, provisional application No. 61/171,395, filed on Apr. 21, 2009.

(51) Int. Cl.

| | |
|---|---|
| ***E05F 3/02*** | (2006.01) |
| ***E05F 3/14*** | (2006.01) |
| ***E05F 3/22*** | (2006.01) |
| ***E05F 3/00*** | (2006.01) |
| ***A47B 95/00*** | (2006.01) |
| ***A47B 95/02*** | (2006.01) |

(52) U.S. Cl. ..... 312/333; 16/66; 16/58; 16/59; 312/319.1

(58) Field of Classification Search ..... 312/333, 312/330.1, 319.1; 384/21; 248/285.1, 287.1, 248/200.1, 429, 122.1; 211/26; 16/66, 58, 16/59

See application file for complete search history.

(56) References Cited

U.S. PATENT DOCUMENTS

| | | | |
|---|---|---|---|
| 1,169,538 | A | 1/1916 | Heber |
| 3,090,988 | A | 5/1963 | Truhon |
| 3,188,683 | A | 6/1965 | Check |
| 3,836,223 | A | 9/1974 | Signore |

(Continued)

FOREIGN PATENT DOCUMENTS

| | | |
|---|---|---|
| BE | 708437 | 5/1968 |

(Continued)

OTHER PUBLICATIONS

International Search Report and the Written Opinion, (PCT/US2010/001172) (11-pgs) (Aug. 13, 2010).

(Continued)

*Primary Examiner* — Darnell Jayne
*Assistant Examiner* — Andrew Roersma
(74) *Attorney, Agent, or Firm* — Pillsbury Winthrop Shaw Pittman LLP

(57) ABSTRACT

A system for assisting the linear movement of a pull-out component relative to a housing includes a first bracket coupled to a slide member of the housing, a second bracket coupled to the pull-out component, and a strut that is pivotally coupled to the first and second brackets at its respective ends. The strut includes an outer hollow member that houses a primary spring, a cylindrical piston that translates through one end of the outer hollow member, and a reverse damping mechanism. A free end of the primary spring is held inside the outer hollow member by a clevis for the first bracket, and its opposite end rests on the piston. The piston's free end includes a clevis for the second bracket. An inner hollow member houses a second spring which regulates movement of a damper shaft such that damping occurs when the shaft is pulled out of the damper.

40 Claims, 40 Drawing Sheets

U.S. PATENT DOCUMENTS

| | | | | |
|---|---|---|---|---|
| 3,854,785 | A * | 12/1974 | Manner et al. | 312/319.1 |
| 4,057,306 | A | 11/1977 | Resch, Jr. | |
| 4,139,249 | A * | 2/1979 | Hillman | 312/333 |
| 4,194,264 | A | 3/1980 | Stoffregen | |
| 4,372,005 | A | 2/1983 | Inesso | |
| 4,629,167 | A | 12/1986 | Kimura et al. | |
| 4,707,882 | A * | 11/1987 | Watts | 16/66 |
| 4,759,099 | A * | 7/1988 | Morano et al. | 16/64 |
| 4,773,125 | A * | 9/1988 | Watabe | 16/53 |
| 4,847,946 | A | 7/1989 | Nam et al. | |
| 4,899,420 | A | 2/1990 | Bye et al. | |
| 4,920,609 | A | 5/1990 | Lin | |
| 5,015,048 | A | 5/1991 | Brunnert | |
| 5,356,207 | A | 10/1994 | Rock et al. | |
| 5,556,179 | A | 9/1996 | Weidner | |
| 5,580,138 | A | 12/1996 | Grabher | |
| 5,946,772 | A | 9/1999 | DeBower | |
| 6,279,754 | B1 | 8/2001 | Hoss et al. | |
| 6,442,796 | B2 | 9/2002 | Arisaka et al. | |
| 6,634,059 | B2 | 10/2003 | Seiferd | |
| 6,702,411 | B2 | 3/2004 | Helver | |
| 6,799,663 | B2 * | 10/2004 | Dubach | 188/322.22 |
| 6,932,200 | B2 * | 8/2005 | Booker et al. | 188/300 |
| 6,976,289 | B1 | 12/2005 | Luca | |
| 6,991,199 | B2 | 1/2006 | Carpentier | |
| 7,104,691 | B2 | 9/2006 | Chi | |
| 7,290,370 | B2 | 11/2007 | McCullough | |
| 7,356,878 | B2 * | 4/2008 | Foster | 16/71 |
| 7,455,154 | B2 | 11/2008 | Bantle et al. | |
| 7,481,397 | B2 | 1/2009 | Steinbeck et al. | |
| 8,091,971 | B2 * | 1/2012 | Ward et al. | 312/333 |
| 2002/0066229 | A1 | 6/2002 | Rubio | |
| 2004/0201338 | A1 | 10/2004 | Mouw | |
| 2005/0155179 | A1 | 7/2005 | Duffy | |
| 2006/0272124 | A1 | 12/2006 | Wartian | |
| 2007/0188060 | A1 | 8/2007 | Nussbaumer et al. | |
| 2007/0194200 | A1 * | 8/2007 | Toma et al. | 248/429 |
| 2008/0180006 | A1 | 7/2008 | Hillen et al. | |
| 2008/0189907 | A1 | 8/2008 | Carter et al. | |
| 2008/0265727 | A1 | 10/2008 | Kohlman et al. | |
| 2008/0284179 | A1 * | 11/2008 | Gerner et al. | 292/13 |
| 2009/0295262 | A1 | 12/2009 | Ward et al. | |

FOREIGN PATENT DOCUMENTS

| | | | |
|---|---|---|---|
| DE | 24 19 116 | | 11/1975 |
| DE | 20 2004 018 629 | U1 | 4/2005 |
| EP | 0 538 550 | A2 | 4/1993 |
| EP | 1 116 846 | A1 | 7/2001 |
| EP | 1 561 398 | A1 | 8/2005 |
| EP | 1 635 025 | A1 | 3/2006 |
| EP | 1 790 251 | A1 | 5/2007 |
| WO | WO 2007/113576 | * | 10/2007 |
| WO | WO 2009/109536 | A1 | 9/2009 |

OTHER PUBLICATIONS http://www.ovisonline.com/store/detail.asp?product_id=4WCBM-2430DM-2 (4-pgs) (Feb. 10, 2009).

* cited by examiner

DAMPENED ASSISTED-MOTION SYSTEMS AND METHODS

RELATED APPLICATION DATA

This application claims priority from Provisional Application Ser. No. 61/237,946, filed Aug. 28, 2009 and Provisional Application Ser. No. 61/171,395, filed Apr. 21, 2009, and is related to application Ser. No. 12/549,699, filed Aug. 28, 2009, all of which are incorporated herein by reference in their entirety.

TECHNICAL FIELD

Aspects of the present invention relate generally to drawer systems and, more specifically, to systems and methods for assisting the opening and closing action of drawers and similar pull-out components, including a damping mechanism to dampen, or soften, the end of the assisted motion of the drawer in both the opening and closing directions.

BACKGROUND OF THE INVENTION

The conventional slide system includes a drawer member and a cabinet member, and may also include an intermediate member. The slide system facilitates the opening and closing of a drawer in a cabinet. Typically, the slide system is mounted between a side of a drawer and a sidewall of a cabinet, with the drawer member affixed to the drawer, and the cabinet member affixed to the cabinet.

The conventional slide system may also include a self-closing mechanism. A typical self-closing mechanism includes a slide component slidably mounted on the cabinet member of the slide system and spring biased in the closing direction, and an engagement component fixedly mounted on the drawer member of the slide system. When the drawer is in the closed position, the engagement component is fully engaged with the slide component. As the drawer is pulled open, the engagement component pulls the slide component in the opening direction of the drawer against the spring force. When the slide component reaches a certain point, it locks into position and releases the engagement component. The slide component remains in the locked position until it is released by the engagement component when the drawer is pushed back to a closed position. Once it is released, the spring biased slide component, now back in full engagement with the engagement component, pulls the engagement component in the closing direction of the drawer, thereby pulling the drawer to a closed position.

Such self-closing mechanisms, however, provide assistance only in the closing direction of the drawer. As such, movement of the drawer in the opening direction is completely unassisted. In addition, even in the closing direction, the typical self-closing mechanism provides assistance only in the latter portion of the drawer's travel, when the drawer has already been pushed inwards most of the way. There is therefore a need for systems that provide assistance in both the opening and closing directions of the drawer and, preferably, along a larger portion of the drawer's travel. In addition, to avoid hard slamming, "bounce-back", and/or noise that may exist at the end of the assisted motion in each of the opening and closing directions, there is a need for assisted-motion systems that include and/or incorporate a damping mechanism to provide a "soft", or damped, end-of-travel effect in both the opening and closing directions.

DETAILED DESCRIPTION

Embodiments of the present invention are directed to systems (and associated methods) that are economical to manufacture, simple to install, remove, adjust, and re-install, easy to customize, and easy to operate for assisting the linear opening and closing motion of drawers and other pull-out components in a manner that provides soft opening, as well as soft closure travel.

It is noted that, in the ensuing description, reference is made to a "drawer" and, more specifically, to a cabinet drawer. However, this is for illustrative purposes only, and not by way of restriction or limitation, and the principles of the inventions described herein may be applied to other pull-out components and/or systems that include one or more pull-out components, such as, for example, office furniture, home furniture, kitchen appliances, general cabinetry (e.g., kitchen, garage, storage, etc.), tool boxes, automotive applications, shelves and shelf systems, etc. In addition, while certain components are described as being coupled to, or engageable with, a cabinet member and others are described as being coupled to, or engageable with, a drawer member, it is understood that, in embodiments of the invention, such coupling and/or engagement may be interchangeable between the cabinet and drawer members. Similarly, where a component is described as being coupled to, or engageable with, one side of a drawer or cabinet, it is understood that, in embodiments of the invention, the component may be coupled to, or engageable with, the opposite side of the drawer/cabinet. In further embodiments, one such component may be coupled to, or engageable with, each side of the drawer/cabinet. It is also noted that descriptors such as "left side" and "right side" are used herein for ease of reference only, and do not restrict the structure, means for manufacturing, or operation of, or otherwise limit, embodiments of the invention.

Figure 1A:
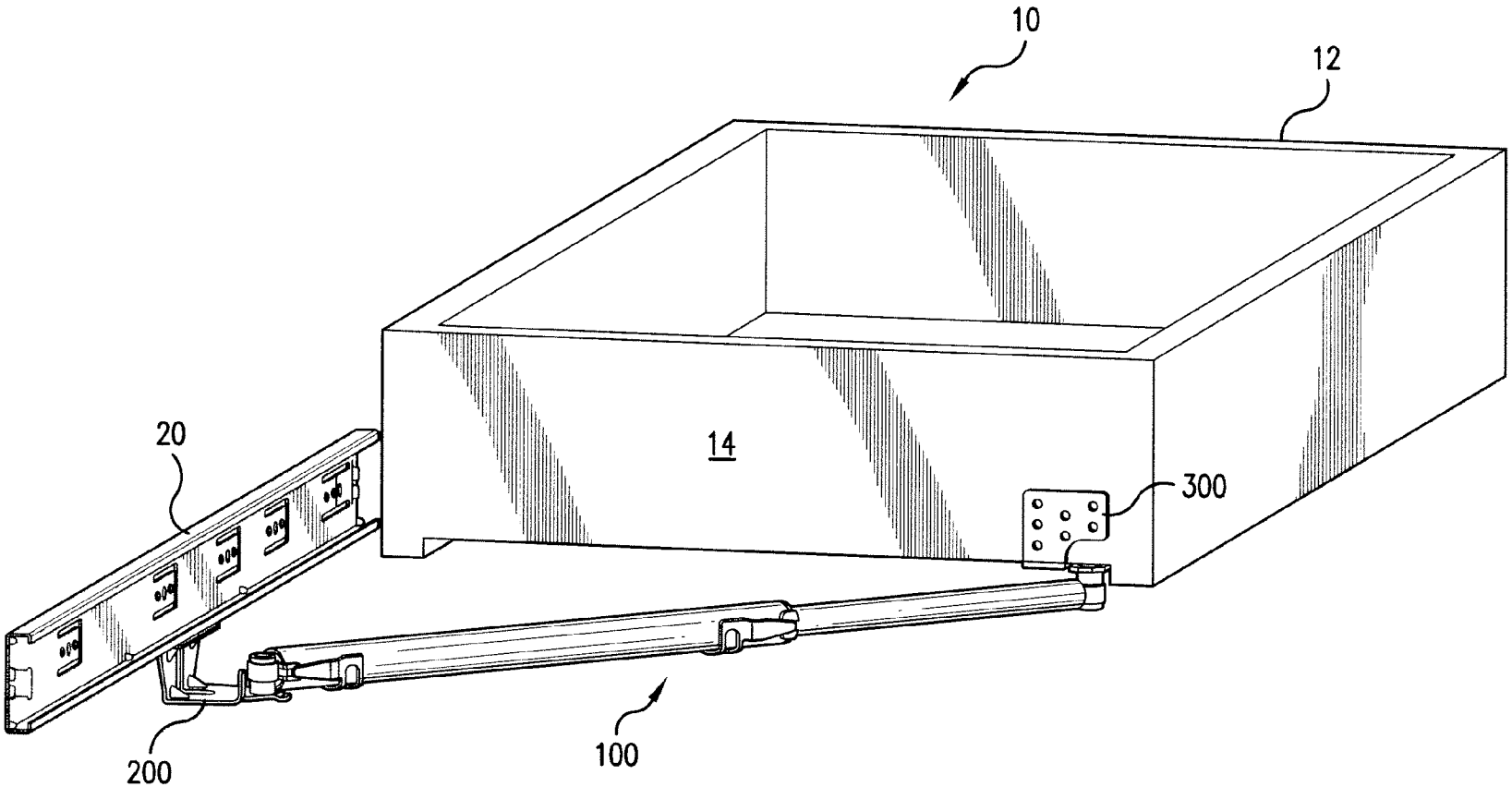
FIGS. 1A and 1B are rear perspective views in accordance with embodiments of the present invention.
Figure 1B:
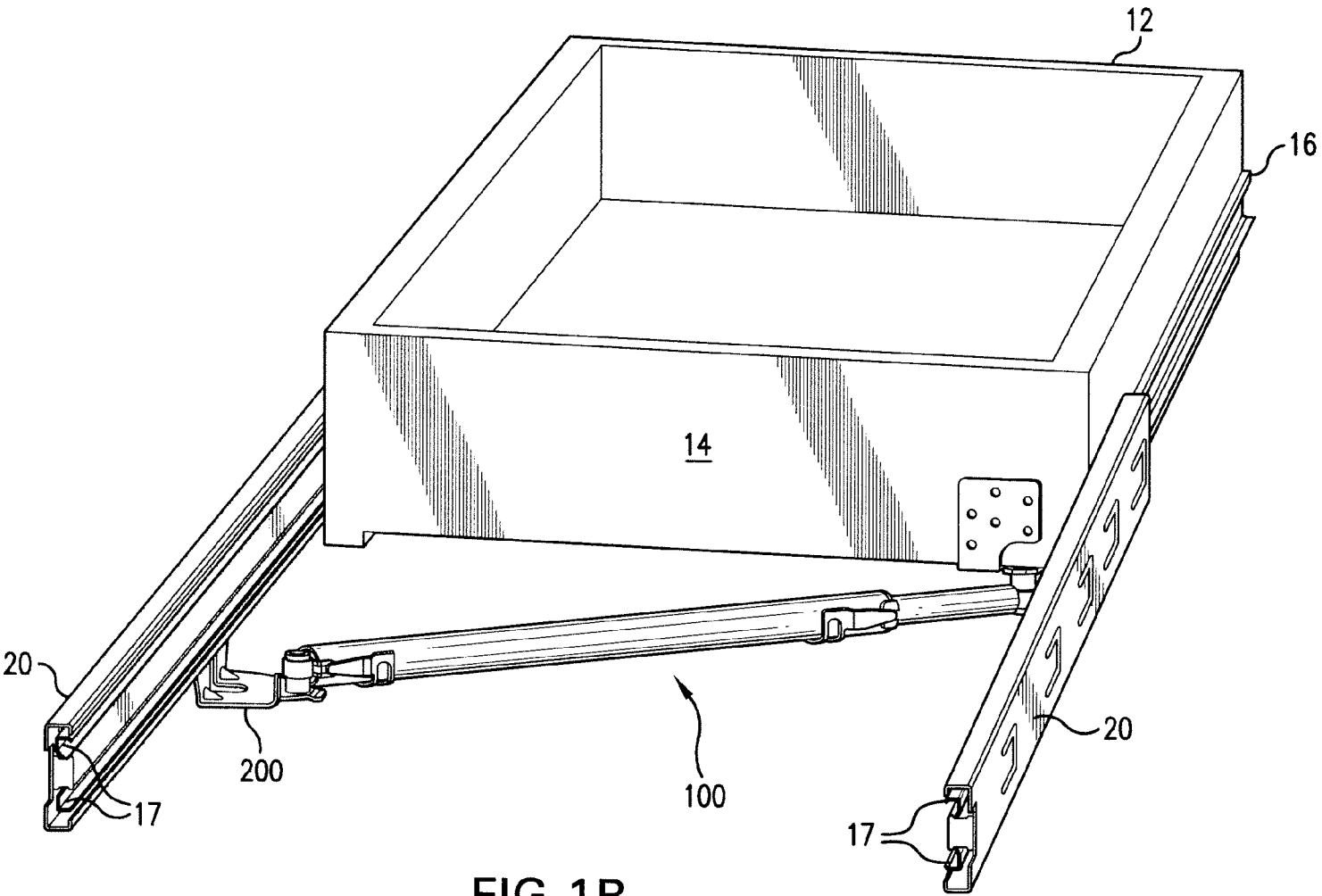
Figure 2:
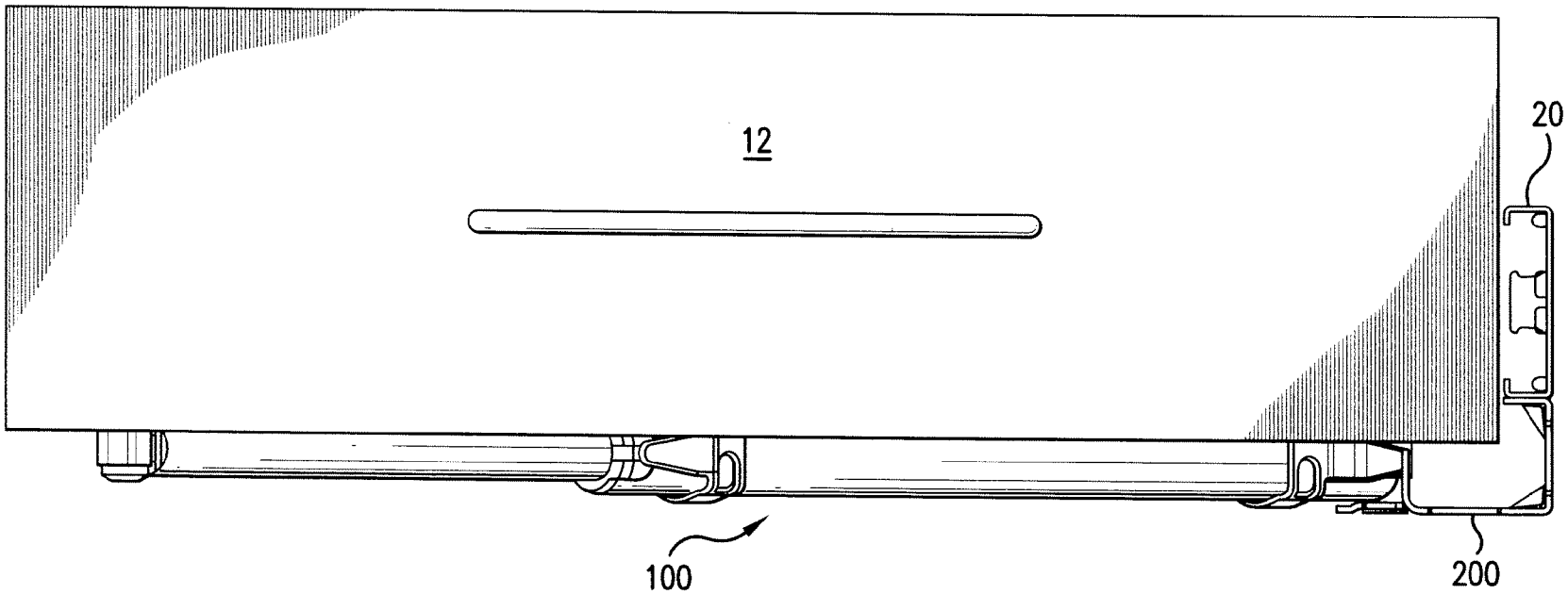
FIG. 2 is front view of the embodiment shown in FIG. 1.
Figure 3:
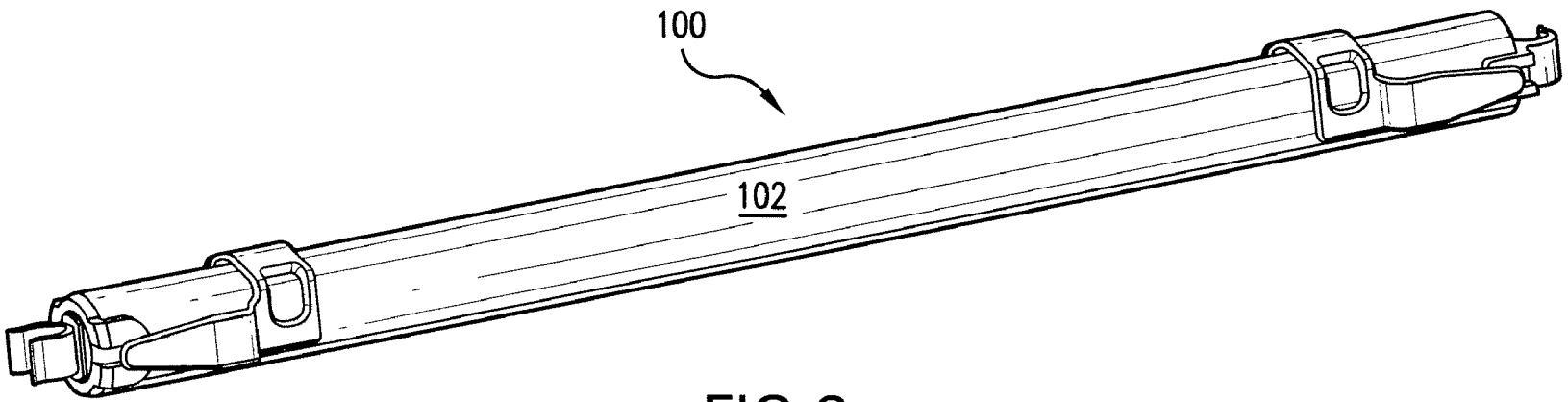
FIG. 3 is a perspective view of a strut in accordance with an embodiment of the present invention.
Figure 4:
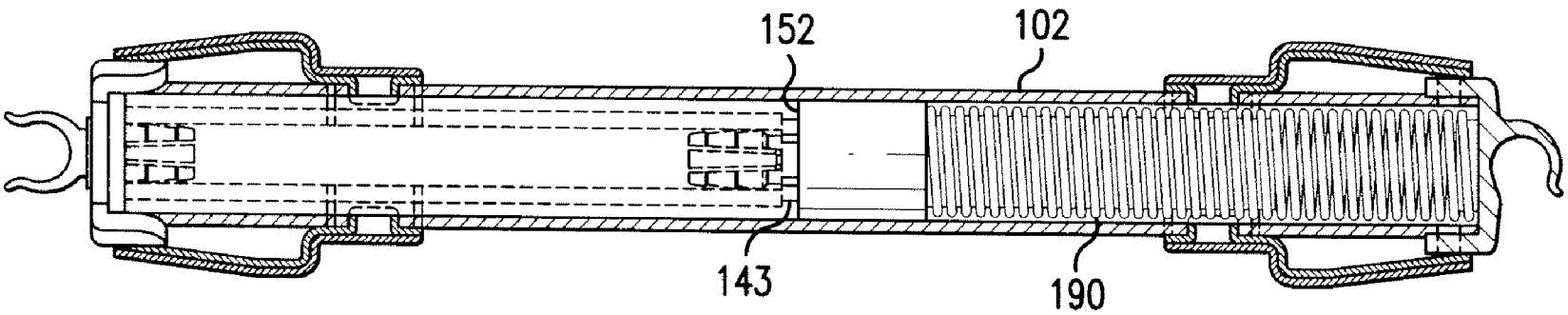
FIG. 4 shows the internal components of the strut shown in FIG. 3 in a closed position.
Figure 5:
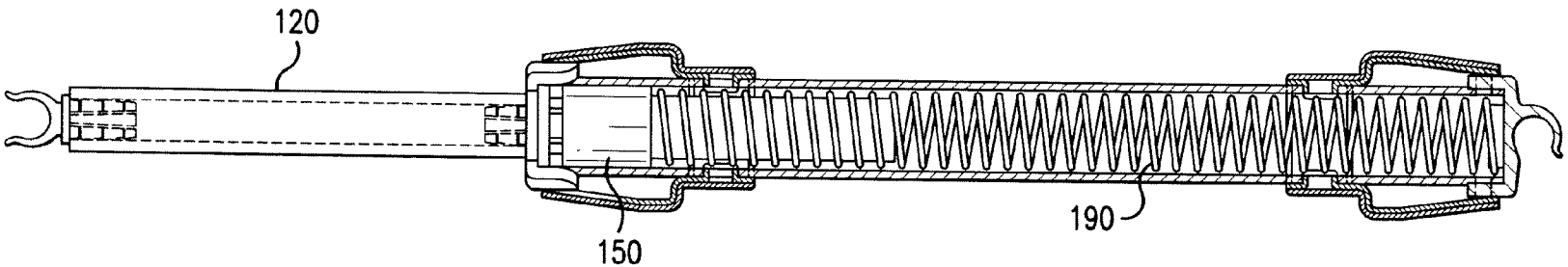
FIG. 5 shows the strut of FIG. 4 in an open position.

As shown in FIGS. 1 and 2, embodiments of the invention are directed to a system in which a drawer 10 moves linearly back and forth, usually within a body, such as, e.g., a cabinet, using slides. For purposes of the instant description, only one outer member (i.e., cabinet member) 20 is shown on the right side of the cabinet, viewed from the perspective of the front face 12 of the drawer shown in FIG. 2. It is to be understood, of course, that, on each of its right and left sides, the drawer 10 may be coupled to a respective cabinet member via a drawer member (e.g., inner, or drawer, member 16 shown in FIG. 1B) attached to a respective sidewall of the drawer, or via a combination of a drawer member 16 and an intermediate member 17 that slides between the drawer and cabinet members. In addition, while the diagrams show an illustrative cabinet member 20 that may be described as having a substantially "C" shaped cross-section, this is by way of example only, and not by way of limitation. Thus, the principles of the inventions herein may be applied to drawer systems with outer members having various other cross-sectional configurations, such as, e.g., a generally "L" shaped configuration, or a generally asymmetrical "C" shaped configuration, wherein the two parallel portions of the "C" are of different lengths, etc. Of course, it is understood that, depending on the configuration of the cabinet member, suitable intermediate and/or drawer members will be utilized that mate operably with the specific cabinet-member configuration.

In accordance with embodiments of the invention, the linear opening (i.e., outwards) and closing (i.e., inwards) motion of the drawer 10 is assisted by a strut 100 that, at one end, may be coupled to the cabinet member 20 via a cabinet member bracket 200 and, at an opposite end, may be coupled to the back (vertical) panel 14 of the drawer 10 via a drawer bracket 300. In embodiments where the pull-out component is a shelf or similar component without a full-height back panel—such as panel 14—the bracket 300 may be coupled to the shelf by coupling either directly onto the rear of the shelf, if the shelf has sufficient thickness proximate its rear end, and/or to the undersurface of the shelf proximate its rear end.

As shown in FIGS. 3-6, the strut 100 includes a tube 102 which, at a first end 103, is detachably coupled to a cabinet bracket clevis 160 and, at a second, opposite end 105, is detachably coupled to a tube cap 110. A rod sub-assembly 119 is configured to translate inwards and outwards through the tube's second end 105 in response to the force exerted by a spring 190.

The rod sub-assembly 119 includes a stem 120 which, in embodiments of the invention, may be tubular throughout its length. See, e.g., FIG. 7. In alternative embodiments, the stem 120 may be solid and/or may have various cross-sectional geometries. In either case, proximate each of its ends 122, 124, the stem 120 still provides a "receptacle" for matingly receiving respective ends of a drawer bracket clevis 130 and a rod tail 140.

Figure 7:
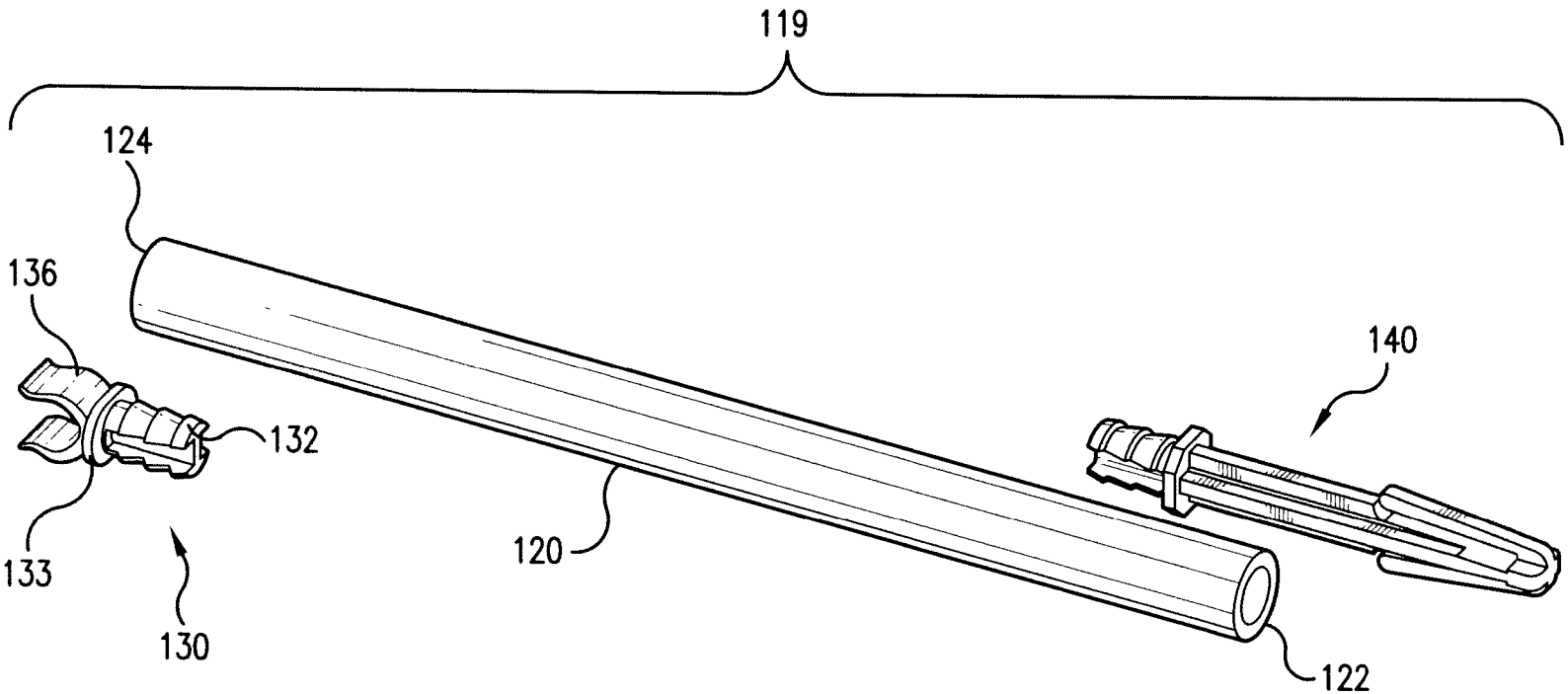
FIG. 7 is an exploded view of the rod sub-assembly shown in FIG. 6.
Figure 8B:
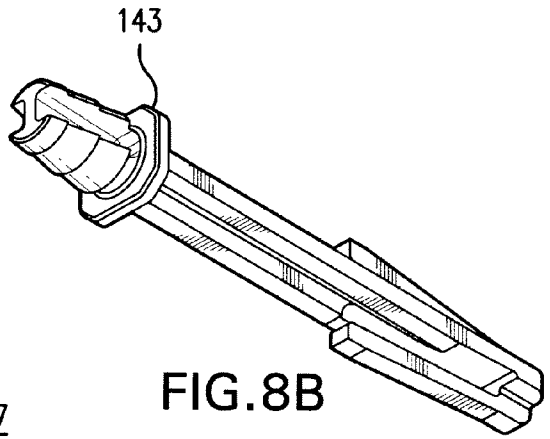
FIG. 8B is the perspective view shown in FIG. 8A, rotated about the rod tail's longitudinal axis by 90°.
Figure 8A:
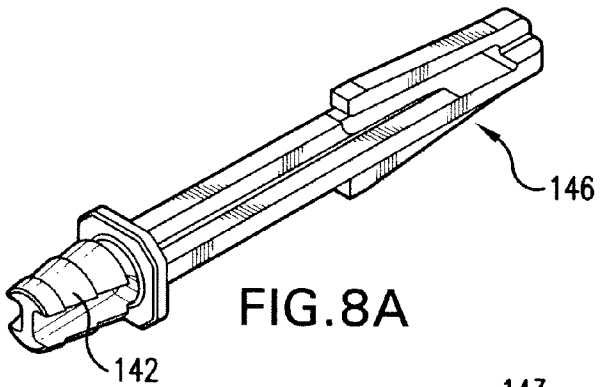
FIG. 8A is a perspective view of the rod tail shown in FIG. 7.
Figure 8C:
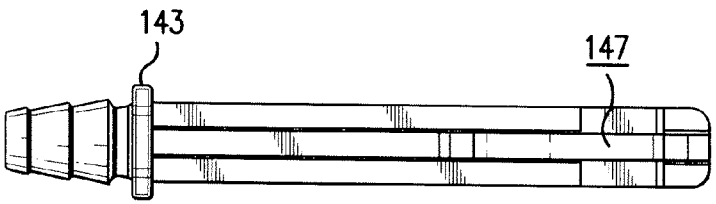
FIG. 8C is a plan view of the rod tail shown in FIG. 8A.
Figure 8D:
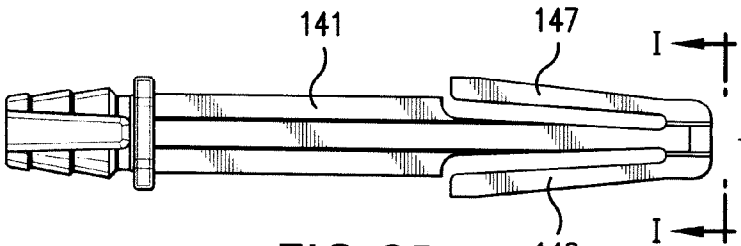
FIG. 8D is the plan view shown in FIG. 8C, rotated about the rod tail's longitudinal axis by 90°.
Figure 8E:
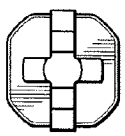
FIG. 8E is an end view along the line I-I of FIG. 8D.

Specifically, as shown in FIG. 7, the drawer bracket clevis 130 has a generally U-shaped coupling portion 136 which sits on a transverse flange 133. The flange 133, in turn, is disposed proximate an end of a press-fit member 132. The press-fit member 132 is configured to be inserted into and matingly fit within the afore-mentioned receptacle at an end 124 of the stem 120. Similarly, the rod tail 140 may have a solid longitudinal portion 141 which, in an embodiment of the invention, may have a "+" shaped cross-sectional configuration. See, e.g., FIGS. 7-8. Proximate one end, the rod tail 140 includes a transverse flange 143 which, in turn, is disposed proximate an end of a press-fit member 142. The press-fit member 142 is configured to be inserted into and matingly fit within the afore-mentioned receptacle at an end 122 of the stem 120.

Thus, where the receptacles at the ends 122, 124 of the stem 120 have a circular cross-section, the press-fit members 132, 142 may be generally conical, so as to be matingly received by, and held within, the respective receptacle at the ends of the stem 120. Other geometries are also possible, as long as the press-fit members can be press fit into and held by the stem's ends. Of course, regardless of the specific geometry, in embodiments where the stem may be solid through most of its length, the receptacle proximate each of its ends must still have sufficient longitudinal depth to receive and hold the entire length of the press-fit member (i.e., up to the flange 133, 143).

Figure 6:
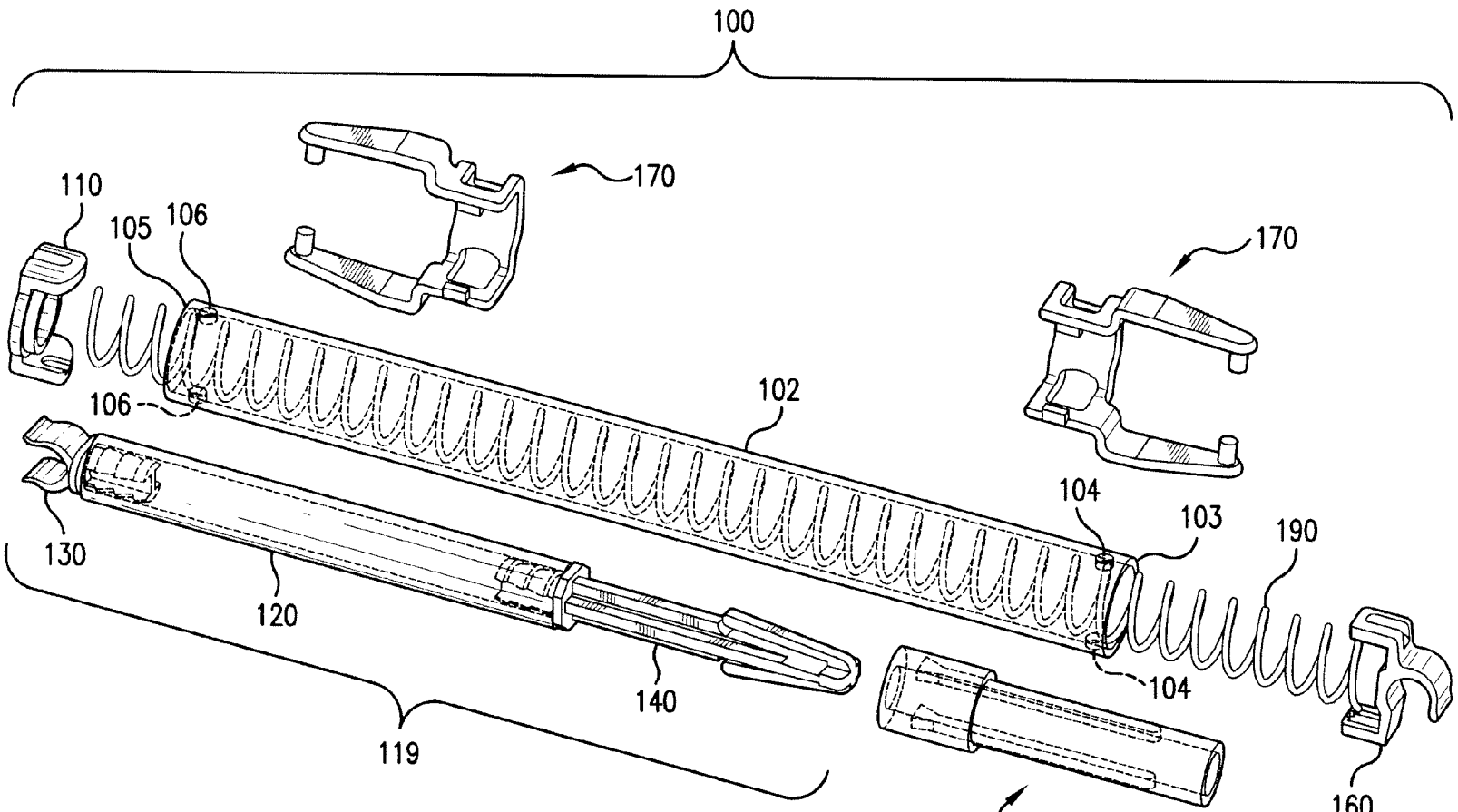
FIG. 6 is an exploded view of a strut in accordance with an embodiment of the present invention.

At its opposite end, the rod tail 140 includes an anchor 146 having a first clip member 147 and a second clip member 148. In embodiments of the invention, the members 147, 148 may be made of elastic and/or resilient material so as to be able to flex towards the longitudinal portion 141. With reference to FIGS. 6, 8, and 9, the anchor 146 serves to secure the rod sub-assembly 119 to a piston 150. More specifically, in the embodiments shown, the longitudinal portion 141 of the rod tail 140 has a "+" shaped cross-sectional configuration, and the clip members 147, 148 are disposed opposite one another around the periphery of the longitudinal portion 141. In such an embodiment, a "+" shaped cross section is advantageous as it provides for reduced mass material (and, therefore, reduced manufacturing costs) as well as simplified molding of the rod tail 140. Nevertheless, in embodiments of the invention, the rod tail may have any other cross-sectional configuration, such as, e.g., circular, and the anchor 146 may include one or more clip members for securing the rod sub-assembly 119 to the piston 150. Where multiple clip members are used, they may be disposed around the periphery of the longitudinal portion 141 of the rod tail in regular intervals. Moreover, in embodiments of the invention, the rod sub-assembly 119 may be manufactured as a unitary component. Alternatively, any two of the rod sub-assembly sub-components, i.e., the stem 120, the drawer bracket clevis 130, and the rod tail 140, may be made as a single integral unit, and then assembled with the remaining sub-component.

Figure 9A:
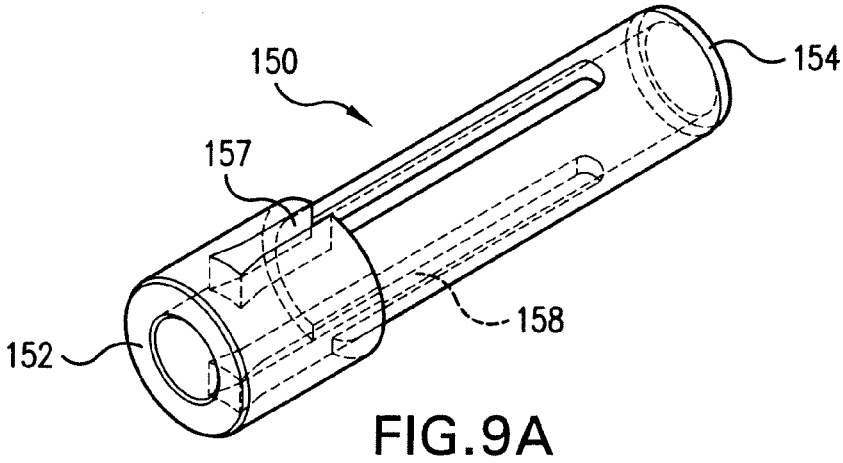
FIG. 9A is a perspective view of the piston shown in FIG. 6.
Figure 9B:
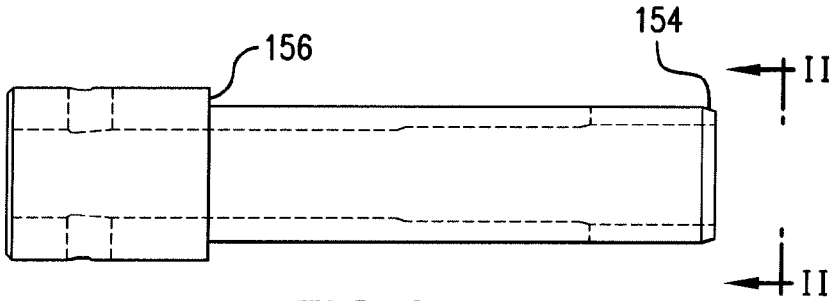
FIG. 9B is a plan view of the piston shown in FIG. 9A.
Figure 9C:
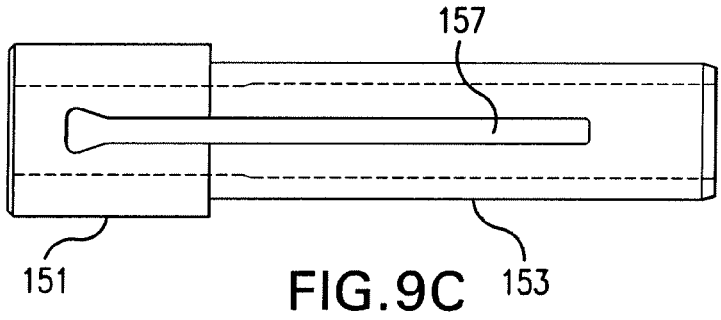
FIG. 9C is the plan view shown in FIG. 9B, rotated about the piston's longitudinal axis by 90°.
Figure 9D:
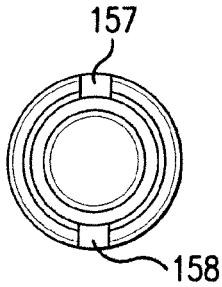
FIG. 9D is an end view along the line II-II of FIG. 9B.
Figure 10A:
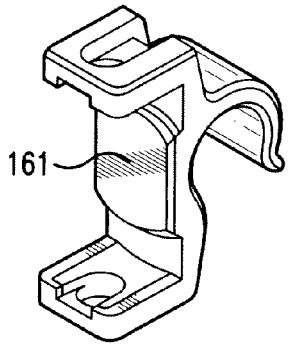
FIGS. 10A-10D show perspective views of a cabinet bracket clevis in accordance with an embodiment of the present invention.
Figure 10B:
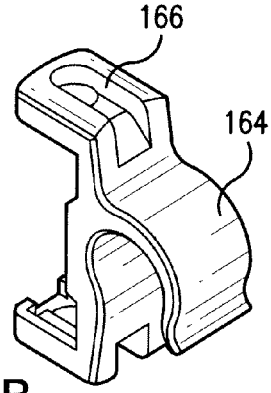
Figure 10C:
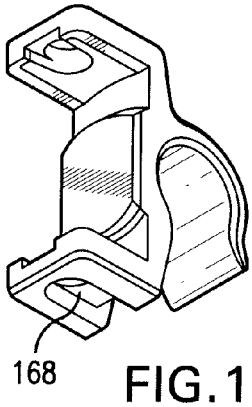
Figure 10D:
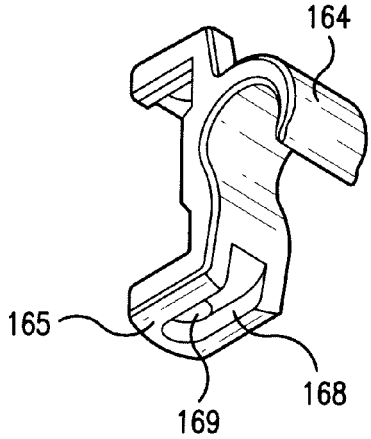
Figure 10E:
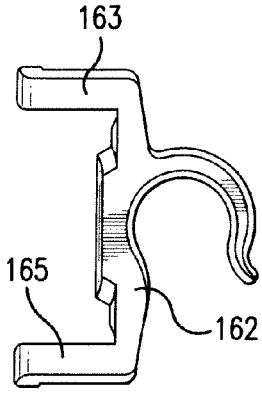
FIG. 10E is a side plan view of the cabinet bracket clevis shown in FIGS. 10A-10D.
Figure 10F:
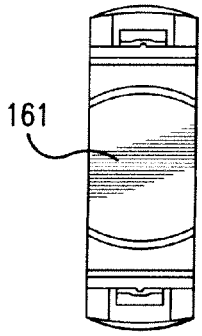
FIG. 10F is a rear plan view of the cabinet bracket clevis shown in FIGS. 10A-10D.
Figure 10G:
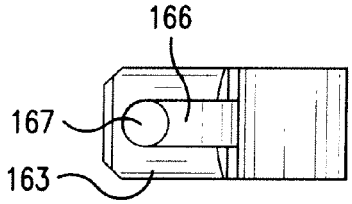
FIG. 10G is a top plan view of the cabinet bracket clevis shown in FIGS. 10A-10D.
Figure 11A:
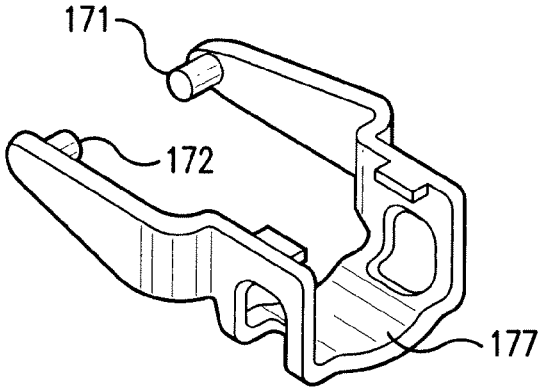
FIGS. 11A-11B show perspective views of a locking clip in accordance with an embodiment of the present invention.
Figure 11B:
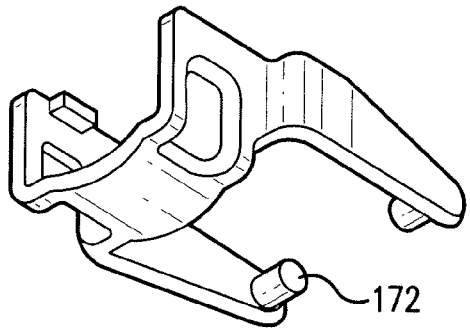
Figure 11C:
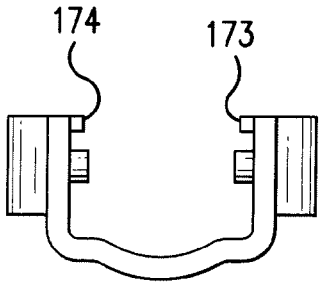
FIG. 11C is an end view of the locking clip shown in FIGS. 11A-11B.
Figure 11D:
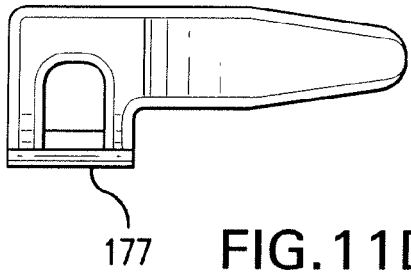
FIG. 11D is a side plan view of the locking clip shown in FIGS. 11A-11B.
Figure 11E:
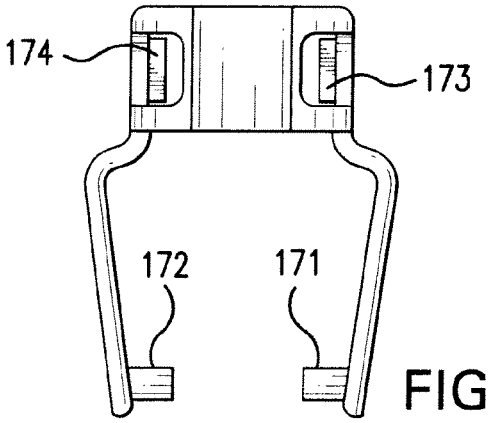
FIG. 11E is a top plan view of the locking clip shown in FIGS. 11A-11B.
Figure 12A:
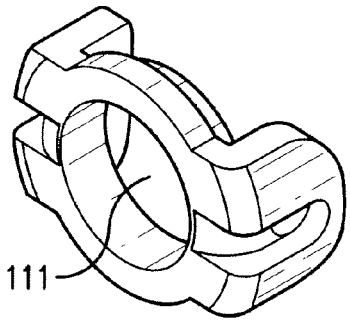
FIGS. 12A-12C show perspective views of a tube cap in accordance with an embodiment of the present invention.
Figure 12B:
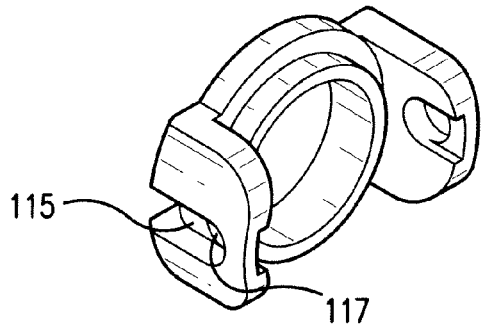
Figure 12C:
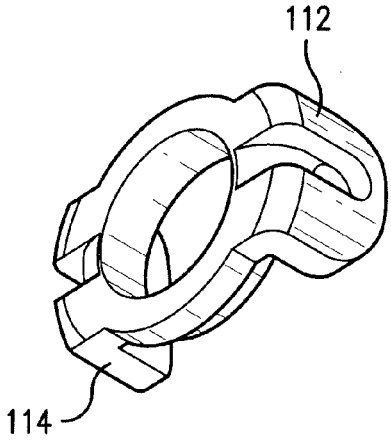
Figure 12D:
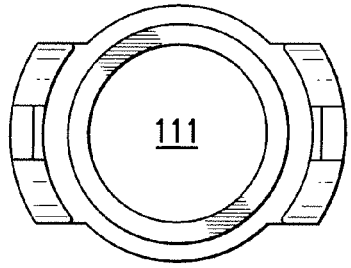
FIG. 12D is a top plan view of the tube cap shown in FIGS. 12A-12C.
Figure 12E:
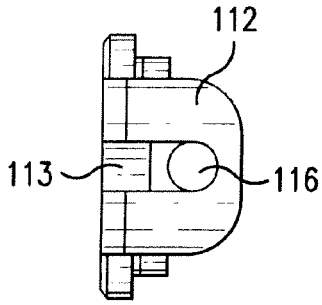
FIG. 12E is a side plan view of the tube cap shown in FIGS. 12A-12C.
Figure 12F:
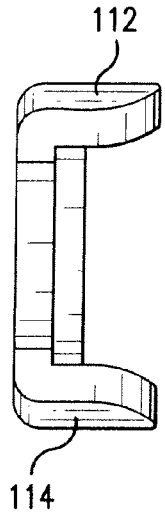
FIG. 12F is the side plan view shown in FIG. 12E, rotated about the tube cap's longitudinal axis by 90°.
Figure 13:
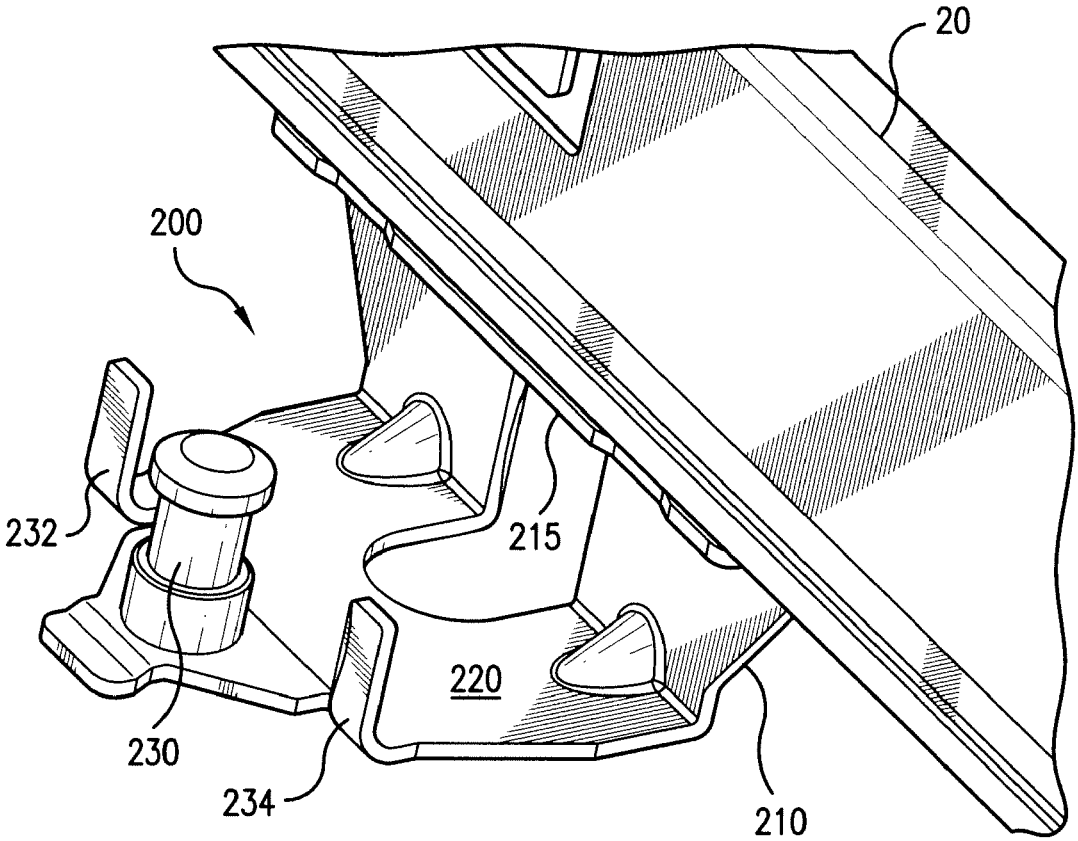
FIG. 13 shows a cabinet member bracket in accordance with an embodiment of the present invention.
Figure 14B:
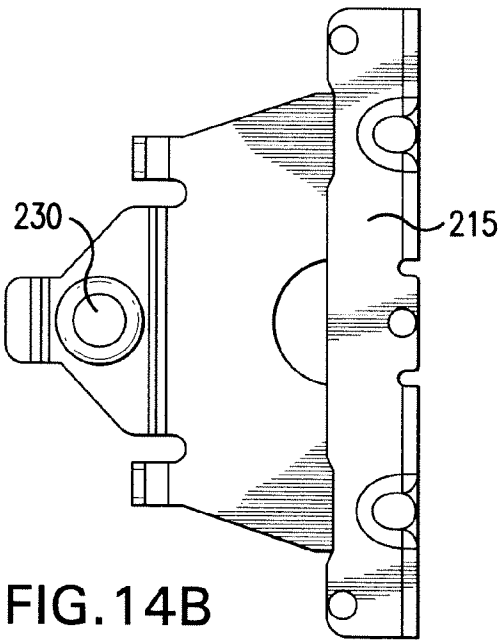
FIG. 14B is a top plan view of the cabinet member bracket shown in FIG. 14A.
Figure 14D:
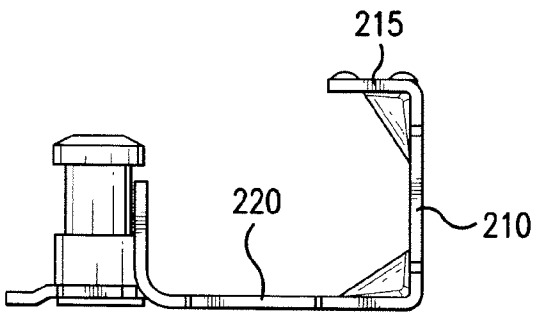
FIG. 14D is a side plan view of the cabinet member bracket shown in FIG. 14A.
Figure 14A:
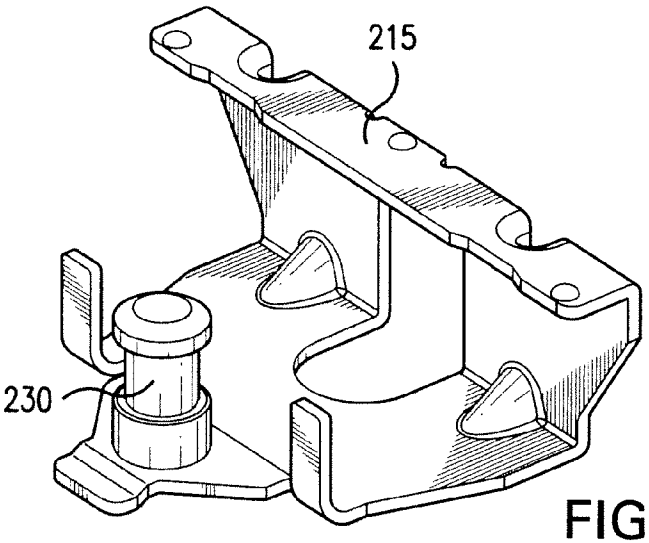
FIG. 14A shows a perspective view of the cabinet member bracket shown in FIG. 13.
Figure 14C:
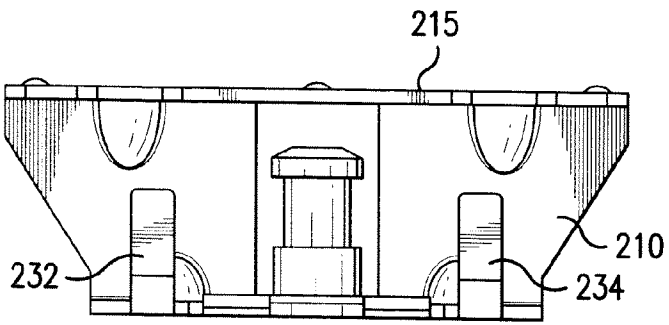
FIG. 14C is a front plan view of the cabinet member bracket shown in FIG. 14A.

In embodiments of the invention, the piston 150 is generally tubular, having a circular cross-section and a first longitudinal portion 151 that has a relatively larger diameter than a second longitudinal portion 153. The transition between the first portion 151 and the second portion 153 defines a ledge 156 upon which rests one end of the spring 190. See, e.g., FIGS. 4 and 5. As shown in FIGS. 9A-9C, the first portion 151 of the piston 150 includes a first end 152, and the second portion 153 includes a second end 154, of the piston 150. To accommodate the clip members 147, 148 of the rod tail 140, the piston also includes respective first and second slots 157, 158 than run longitudinally through the wall of the piston 150, spaced 180° apart from one another. Thus, during operation, the end 152 of the piston 150 may generally rest on a side of the flange 143 of the rod tail 140.

As noted, the instant description is provided by way of illustrative example, rather than limitation. In the illustrative example, the spring 190 is a compression spring, although various types of springs may be used in embodiments of the invention. As noted previously, one end of the spring 190 may be in contact with the ledge 156 of the piston 150. With reference to FIGS. 6 and 10-12, in embodiments of the invention, the opposite end of the spring 190 is in contact with a cabinet bracket clevis 160.

More specifically, the cabinet bracket clevis 160 includes a spine 162 that is relatively flat on a first side 161 and, on a second opposite side, is integral with a coupling member 164. The spine 162 is also integral with two extension arms 163, 165, each of which extends substantially perpendicularly to the spine 162 and includes a respective longitudinal slot 166, 168. At its base, the longitudinal slot 166 includes an aperture 167. Similarly, the longitudinal slot 168 includes an aperture 169 at its base.

As shown in FIG. 6, proximate its end 103, the tube 102 includes two radially opposite (i.e., spaced apart 180° from each other), transverse apertures 104. Similarly, proximate its end 105, the tube 102 includes two radially opposite, transverse apertures 106. When assembled, the cabinet bracket clevis 160 is placed on the end 103 of tube 102, with one of the apertures 104 being aligned with the aperture 167 of slot 166, the other aperture 104 being aligned with the aperture 169 of slot 168, and an end of the spring 190 resting on the first side 161.

In embodiments of the invention, the cabinet bracket clevis 160 and the tube 102 are held together via a locking clip 170. See FIGS. 4-6 and 11. At one end, the locking clip 170 has a generally U-shaped brace 177 that is configured to contact the periphery of the tube 102. At the end of each of the vertical sections of the "U", the clip 170 includes an extension 173, 174, which help detachably secure the clip to the tube. At an end opposite the brace 177, the clip 170 includes transverse protrusions 171, 172 which, upon coupling of the clip to the tube 102, are received in respective ones of the apertures 167, 169 of the cabinet bracket clevis 160, as well as in respective ones of the apertures 104.

On an opposite end 105 of the tube 102, the rod sub-assembly 119 and the spring 190 are maintained within the tube by the combination of a tube cap 110 and a second locking clip 170. As shown in FIGS. 12A-12F, the tube cap 110 is generally in the shape of a circular ring, defining therethrough an orifice 111. On radially opposite sides, the tube cap 110 includes a first extension arm 112 having a longitudinal slot 113, and a second extension arm 114 having a longitudinal slot 115. The longitudinal slot 113, in turn, has an aperture 116 at its base. Similarly, the longitudinal slot 115 has an aperture 117 at its base. Thus, when assembled, the tube cap 110 is placed on the end 105 of tube 102, with one of the apertures 106 being aligned with the aperture 116 of slot 113, the other aperture 106 being aligned with the aperture 117 of the slot 115, and the coupling member 136 of the drawer bracket clevis 130 protruding through the orifice 111.

In addition, as described above in connection with the end 103 of the tube 102, a locking clip 170 is coupled to the tube 102 such that a first transverse protrusion 171 is received in the aperture 116 of slot 113 and in one of the apertures 106, and the second protrusion 172 is received in the aperture 117 of slot 115 and in the other one of the apertures 106. It is noted that, in embodiments of the invention, pins—such as, e.g., dowel pins—may be used to couple the tube cap 110 to the tube 102 through the orifice(s) 106, and the cabinet bracket clevis 160 to the tube 102 through the orifice(s) 104, thereby obviating the need for the locking clips 170. Thus, while fewer components would need to be manufactured, the assembly process may be more labor intensive. In addition, when the locking clips 170 are used, the strut 100 may be disassembled more quickly and more easily when needed, including for repair and/or replacement of components, such as, e.g., a failed spring, in the field.

An embodiment of the cabinet member bracket 200 is shown in FIGS. 13 and 14A-14D. With reference to FIGS. 1 and 2, the cabinet member bracket 200 is a generally "C" shaped member having a vertical spine 210, an upper horizontal surface 215, and a lower horizontal surface 220. Extending vertically upwards from the lower horizontal surface 220 are clevis pin 230 and vertical tabs (or fingers) 232, 234. In embodiments of the invention, the clevis pin 230 may be, e.g., riveted to the surface 220, and the bracket 200 may be, e.g., spot-welded (or otherwise coupled) to the cabinet member 20.

Figure 15:
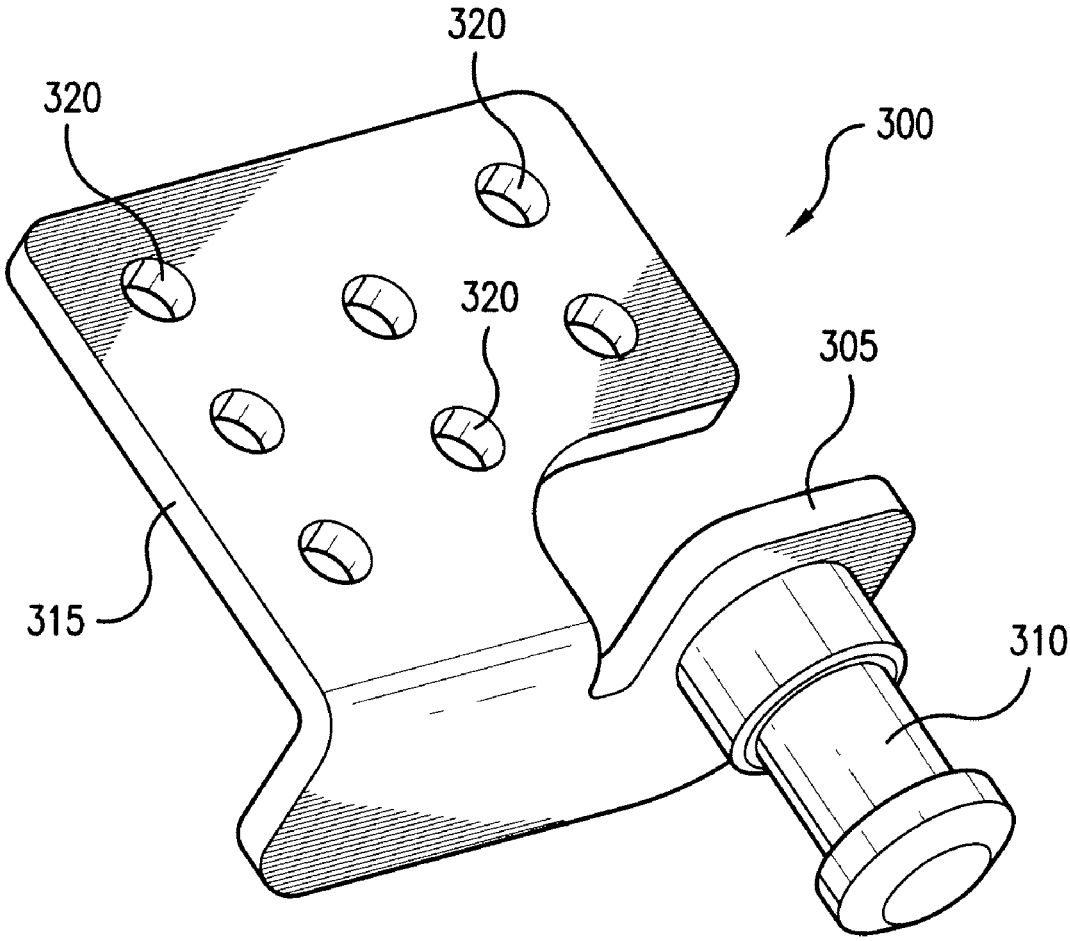
FIG. 15 is a perspective view of a drawer bracket in accordance with an embodiment of the present invention.
Figure 16:
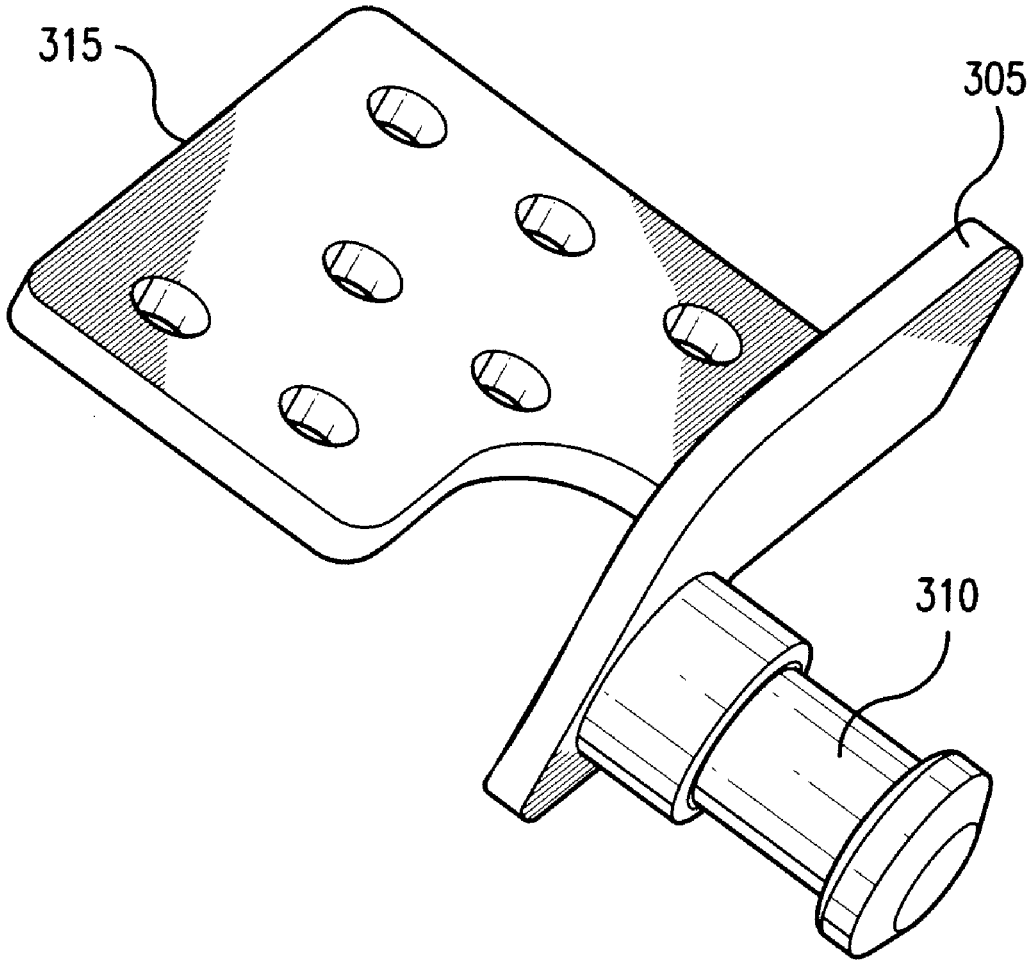
FIG. 16 is another perspective view of the drawer bracket shown in FIG. 15.

FIGS. 15 and 16 show the drawer bracket 300. In the embodiment shown in these figures, the drawer bracket 300 has a vertical section 315 that is integral with a horizontal section 305 to form a substantially "L" shaped member. The vertical section 315 may include one or more transverse attachment holes 320 for coupling the drawer bracket 300 to the drawer 10. In addition, a clevis pin 310 extends vertically downwards from an underside of the horizontal section 305. As with the clevis pin 230, clevis pin 310 may be, e.g., riveted to the horizontal section 305 of the bracket 300.

As noted previously, in embodiments where the pull-out component is a shelf or similar component without a full-height back panel—such as panel 14 of drawer 10—the bracket 300 may be coupled to the shelf by coupling either directly onto the rear of the shelf, if the shelf has sufficient thickness proximate its rear end, and/or to the undersurface of the shelf proximate its rear end. In these, and other similar instances, the vertical section 315 of the bracket 300 may be modified—e.g., some, or all, of the vertical section 315 may be rotated counterclockwise by 90° so as to be parallel to, or coplanar with, the horizontal section 305—or even eliminated altogether, as warranted by the characteristics of the shelf. In the latter case, where the vertical section 315 is eliminated, the horizontal section 305 may include one or more transverse attachment holes for coupling the bracket 300 to, e.g., an undersurface of the shelf.

Figure 17:
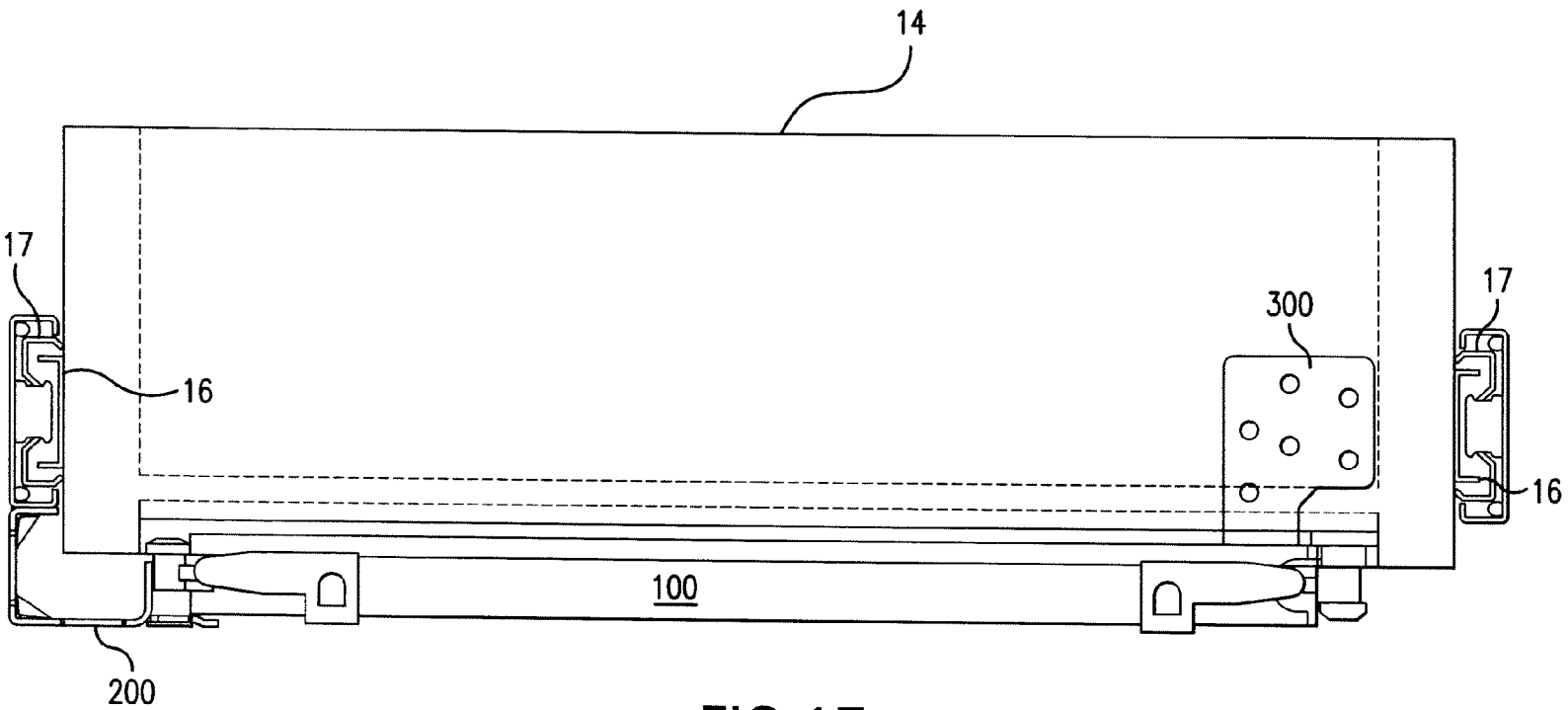
FIG. 17 is a plan view in accordance with an embodiment of the present invention.

With reference to FIGS. 1-5, in an embodiment of the invention, a drawer bracket 300 is coupled to the vertical panel 14 at the backside of the drawer 10 using screws or other fastening means in combination with the attachment holes 320. FIG. 17 shows a plan view of a strut 100 that may be detachably coupled to a drawer bracket 300 and a cabinet member bracket 200.

A cabinet member bracket 200 is welded onto, or otherwise coupled to, the cabinet member 20 at approximately the longitudinal midpoint of the slide travel which, in embodiments of the invention, corresponds to the longitudinal midpoint of the drawer travel. With the brackets 200, 300 in place, the strut 100 may be coupled between the two brackets in order to urge the drawer towards both the open and closed directions. Specifically, on one side, the strut 100 is connected by engaging the coupling member 164 of the cabinet bracket clevis 160 to the clevis pin 230 of the cabinet member bracket 200. On the opposite side, the strut 100 is connected by engaging the coupling member 136 of the rod-subassembly 119 to the clevis pin 310 of the drawer bracket 300.

In operation, the strut 100 serves to apply a limited force to the drawer 10 to urge it to open, when it is partially open, or to close, when partially closed. Specifically, as the drawer is pulled out, the angle of the strut 100 relative to the line of motion (or travel) changes from about −40° to about +40°. The longitudinal component of the force applied by the spring 190—and, therefore, through the strut 100—either resists or assists the motion of the drawer 10, while the crosswise component of the force is countered by reaction of the slides.

As noted before, in order to maximize the stroke length of the system, the cabinet member bracket 200 is mounted about mid-stroke, resulting in about 40% of the stroke resisting, and about 40% of the stroke assisting, the motion of the drawer 10. In the middle of the stroke, i.e., in a region around "dead center", where the strut is essentially perpendicular to the cabinet member 20, the crosswise force is at a maximum, as the spring 190 is maximally compressed. Therefore, in this middle portion, comprising about 20% of the entire stroke, slide movement effort is minimal as there is essentially no longitudinal force component and, as such, no motion-assist in either direction.

Thus, starting from a closed position, as the drawer 10 is pulled open, the longitudinal component of the spring force resists the drawer's outward motion, until the above-mentioned middle portion is reached. As the drawer continues to be pulled open through the middle portion, the outward motion of the drawer is essentially unaffected by the strut. However, once the end of the middle portion—i.e., about 60% of travel—is reached, the spring's expansion assists the outward motion of the drawer until the drawer has reached the fully open position.

Similarly, from the fully open position, as the drawer is pushed inwards toward the closed position, the spring resists the drawer's motion as it is compressed. The resistance then ceases through the middle portion of travel. Once again, at about 60% of (inward) travel, the spring's expansion assists the inward motion of the drawer until the drawer has reached the fully closed position.

In the embodiments shown in the figures, the coupling members 136 and 164 are held together by molded clip-locks that basically provide for snap-on connection to the respective clevis pins 310, 230. As such, an important advantage of aspects of the invention is that the strut 100 may be detached or taken apart and reassembled very quickly without the need for hand tools.

Similarly, an end user can disconnect and remove the drawer without the need to reach behind the drawer and disconnect the strut. The resilient spring action of the coupling member 136 will frictionally release from the drawer bracket clevis pin 310 as the drawer members 16 are disconnected from the intermediate members 17 and/or the cabinet members 20 and the drawer 10 is pulled and removed from the cabinet structure. Thus, the ability to easily disconnect the strut and remove the drawer may be realized when the drawer members are disconnectable from the intermediate and/or cabinet members.

An additional advantage of embodiments of the invention is the potential to "dial" in spring forces for specific (OEM) type applications. That is, a custom spring could be specified, with a higher (or lower) spring rate based the specific needs of the user and the system's intended application.

A further advantage of embodiments of the invention is provided through the rod-subassembly 119. More specifically, at the end of stroke, i.e., with the spring 190 fully extended, and the drawer 10 in the fully open position, the clip members 147, 148 are able to travel outwards (i.e., in the extension direction) through the respective slots 157, 158 for an additional distance, which provides an un-assisted extension at the end of stroke. In embodiments of the invention, this feature may allow about one inch of extension from the piston when it reaches the end of stroke. This, in turn, may correspond to, e.g., about 1.5" of un-assisted travel for the drawer 10, assisting the connection of the clevis to the clevis pin 310. This feature is useful for disconnecting and reconnecting the drawer to the strut, especially within a vertical bank of drawers, with limited access to the back of the drawer boxes. The clevis pin on the drawer bracket may be offset to the rear to improve visibility, aiding the connecting activity.

In this regard, it is also noted that the fingers 232, 234 of the cabinet member bracket 200 serve to prevent the strut 100 from becoming oriented too close to parallel, relative to the cabinet member 20, when the drawer 10 is removed. Thus, fingers 232, 234 may be used to prevent damage to the strut 100 when the drawer 10 is reinserted, as the strut may be contacted by the lower portion and/or corner of the drawer. In short, the fingers 232, 234 restrict the strut from moving into an unfavorable position for/during reinsertion of the drawer.

It is important to note that embodiments of the invention may be used in association with standard slides ranging from, e.g., 12 to 28 inches in length. Various strut sizes may be provided in order to cover the range of strokes for the above-mentioned lengths, while fitting in specific narrow drawers. As noted above in connection with FIG. 17, drawer width limitations as related to drawer slide length are predicated on the available cross space when the strut rotates into the middle zone of action, during either the opening or the closing motion.

Various components described herein may be "standard", or common, regardless of the strut size (length) that is used. For example, both locking clips 170, the clevis pins 230, 310, the tube cap 110, and the rod tail 140 may be used interchangeably among various struts. In addition, the spring coil diameter, wire diameter, and pitch may be common to the various strut sizes, with only the free length varying accordingly. The spring is designed with substantial margin for its stroke, and a certain amount of adjustment for the open and closing assist force is possible by slightly varying the spring's free length.

With limitations on drawer widths, as previously mentioned, the length of travel or stroke may be greater than the width of the drawer. This condition places a high demand on the usable stroke of the spring, as it is desirable to provide maximum stroke, with minimal spring force. For this condition, minimal space is taken by the common components (mentioned above), to achieve the maximum assisted stroke within the aforementioned limited drawer width.

Figure 18:
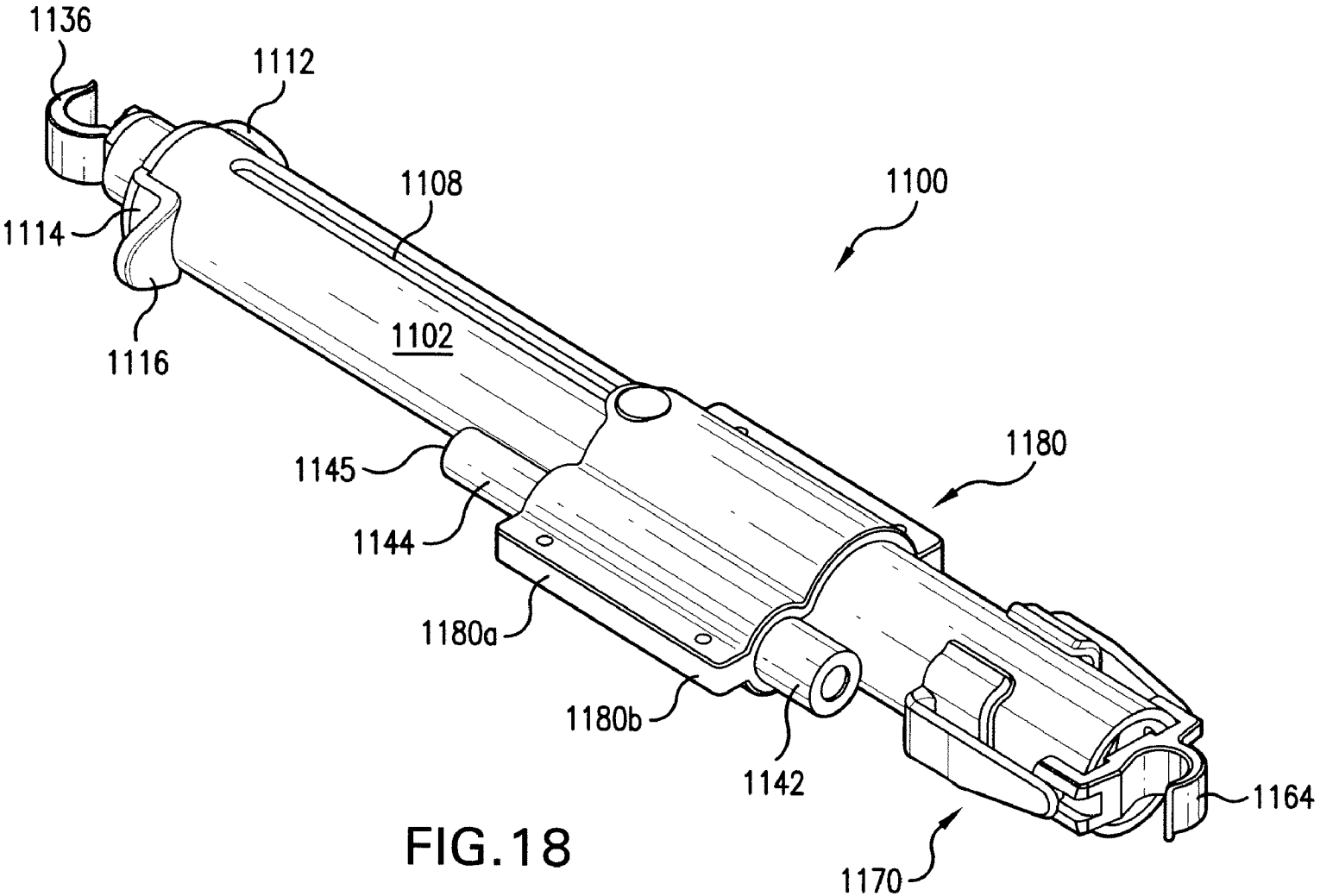
FIG. 18 is a perspective view of a strut in accordance with an alternative embodiment of the present invention.
Figure 19:
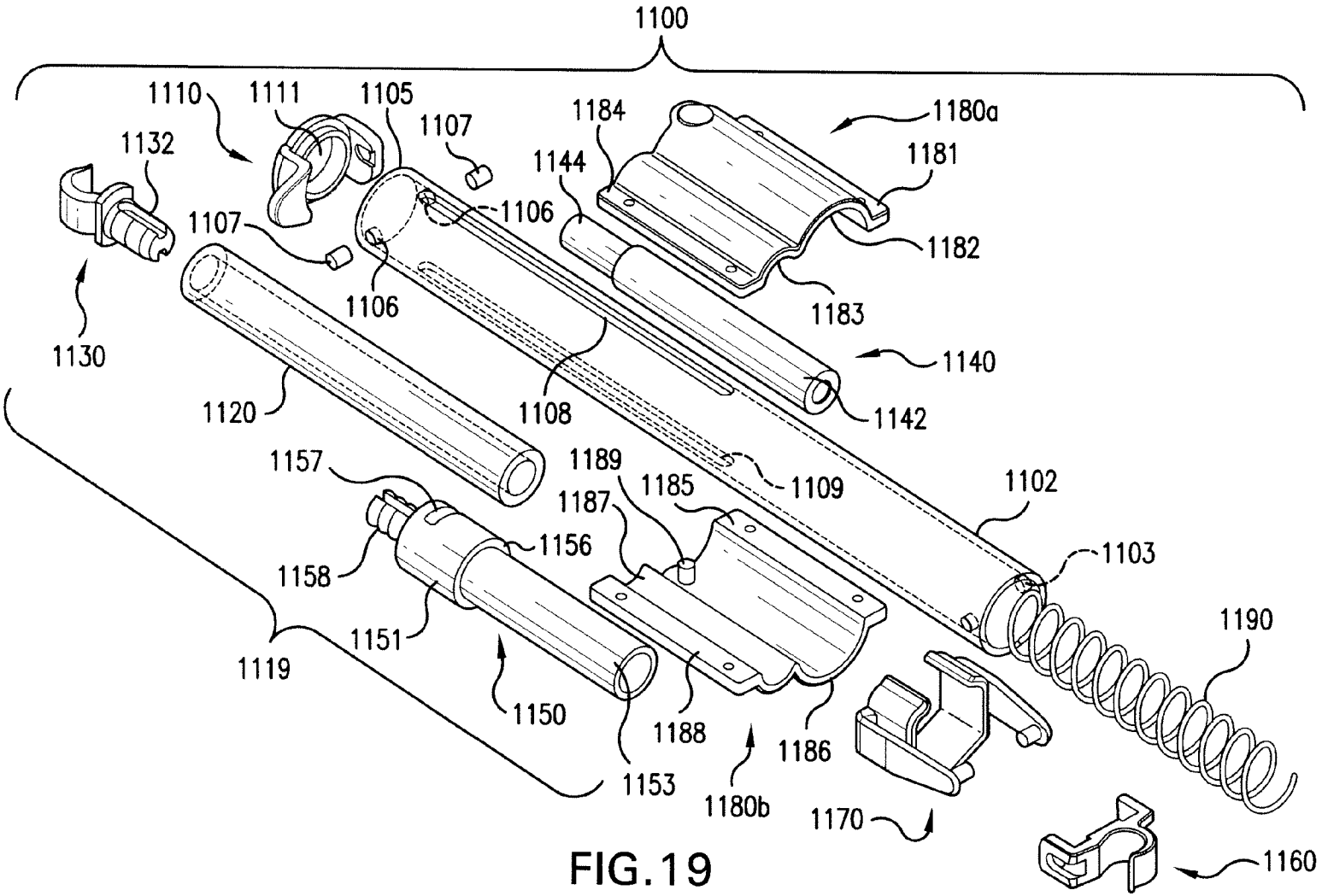
FIG. 19 is an exploded view of the strut shown in FIG. 18.

An illustrative example of an alternative embodiment including a damping mechanism is shown in FIGS. 18 and 19. As shown, similar to the strut 100 (see, e.g., FIG. 6), the strut 1100 includes a tube 1102 having a first end 1103 and a second end 1105, and receiving therein a spring 1190 and rod sub-assembly (or carriage, as described more fully below) 1119. At its first end 1103, the tube 1102 is detachably coupled to a cabinet bracket clevis 1160 having a coupling member 1164 via a locking clip 1170; locking clip 1170, in turn, may be sized, e.g., made longer or shorter, depending on the specific strut that is used. At its second end 1105, the tube 1102 is detachably coupled to a tube cap 1110.

In contrast to the strut 100, however, the strut 1100 includes an integrated damping mechanism (or damper) 1140 which is configured to soften, or dampen, the end of the assisted motion of the drawer in both the opening and closing directions. Thus, in conjunction with the carriage 1119, the damper 1140 serves to enhance the operation of the systems described herein by substantially reducing or eliminating any "bounce-back" and/or noise that may exist at the end of the assisted motion in each of the opening and closing directions.

As with the embodiments described previously, the rod sub-assembly, or carriage 1119 includes a rod 1120, a drawer bracket clevis 1130, and a piston 1150. Moreover, the piston 1150 has a first longitudinal portion 1151 and a second longitudinal portion 1153 with a relatively smaller diameter than the first longitudinal portion 1151, with the transition between the first and second longitudinal portions defining a ledge 1156 upon which rests one end of the spring 1190. However, the carriage 1119 no longer includes a rod tail. Rather, proximate the free end of the first longitudinal portion 1151, the piston 1150 now includes a press-fit member 1158 that is received directly in a receptacle at one end of the rod 1120. At its opposite end, the rod 1120 receives a press-fit member 1132 of the drawer bracket clevis 1130.

In the embodiment shown in FIGS. 18 and 19, the damper 1140 may be an air damper having a cylinder 1142 and a damper piston 1144 with approximately a 1" stroke. The damper 1140 may be detachably secured to the piston 1150 by a clamping mechanism having two identical halves, or clamp shells, 1180*a*, 1180*b*. Each of the clamp shells 1180*a*, 1180*b* includes a first arcuate portion 1182, 1186 which, together, brace (a portion of) the periphery of the tube 1102, and a second arcuate portion 1183, 1187 which, together, brace (a portion of) the periphery of the damper 1140. Adjacent said first arcuate portion, each clamp shell includes a first extension 1181, 1185, and adjacent said second arcuate portion, each clamp shell includes a second extension 1184, 1188. As shown, the two clamp shells 1180*a*, 1180*b* may be held together by using, e.g., screws, rivets, etc. to couple together the first extensions 1181, 1185 and the second extensions 1184, 1188.

Each of the clamp shells includes a transverse pin that extends perpendicularly from an inner surface of the shell. Thus, for example, the clamp shell 1180*b* includes a pin 1189 that extends perpendicularly from an inner surface of the first arcuate portion 1186; a similar pin, not shown, extends perpendicularly from the inner surface of the first arcuate portion 1182 of the clamp shell 1180*a*.

To operationally couple the damper 1140 to the carriage 1119 and, therefore, the strut 1100, the tube 1102 includes respective first and second slots 1108, 1109 that run longitudinally through the wall of the tube, spaced 180° from one another. Similarly, the piston 1150 includes a first slot 1157 and second, opposing slot (not shown), that are also spaced 180° from one another and are aligned, respectively, with the longitudinal slots 1108, 1109. As shown, the transverse pin 1189 is received into a slot opposite slot 1157 of the piston 1150 through the longitudinal slot 1109 of the tube 1102. Similarly, the transverse pin of the clamp shell 1180*a* (not shown) is received into the slot 1157 of the piston 1150 through the longitudinal slot 1108 of the tube 1102. With this construction, the damper 1140 translates back and forth along the tube 1102 in concert with the piston 1150.

As with previously-described embodiments, at its end 1105, the tube 1102 is coupled to a tube cap 1110 having a first extension arm 1112 (with a first tube-cap slot having an aperture therein) and an opposing second extension arm 1114 (with a second tube-cap slot and also having an aperture therein). Thus, when assembled, the tube cap 1110 is placed on the end 1105 of tube 1102, with one of the apertures 1106 of the tube 1102 being aligned with the aperture of the first tube-cap slot, the other aperture 1106 being aligned with the aperture of the second tube-cap slot, and the coupling member 1136 of the drawer bracket clevis 1130 protruding through the orifice 1111.

However, rather than being coupled to one another through a locking clip, the tube cap 1110 and the tube 1102 are coupled via tube cap pins 1107. In addition, the second extension arm 1114 now includes a transverse (with respect to the second extension arm) flange 1116. In operation, the flange 1116 is disposed such that it is on the same side of the tube 1102 as the damper 1140, and is oriented so as to serve as a contact point with an end 1145 of the damper piston 1144, thereby slowing the strut travel at each end (i.e., drawer opening and drawer closing) of the assisted motion (see FIG. 18).

Also, the generally U-shaped coupling member 1136 of the drawer bracket clevis 1130 is rotated, i.e., from an axial direction with respect to the strut, to a perpendicular direction, such that the assembly to the drawer clevis pin is in a rotational arc, swinging the strut assembly into position and snapping the coupling member 1136 to the drawer clevis pin from the side. This side directional connection helps eliminate inadvertent disengagement of the strut from the drawer at the end of the dampened travel. The structure of the coupling member 1136 of the drawer bracket clevis 1130, therefore, is quite similar to that of the coupling member 1164 of the cabinet bracket clevis 1160.

As noted, the presently-disclosed embodiments are to be considered in all respects as illustrative and not restrictive. For example, in embodiments of the invention, a strut may be coupled to each side of a drawer system, in which case the width of the drawer must be greater than double the minimum length for each strut assembly, in order to ensure that the struts stay on the same plane while, at the same time, clearing each other when in the horizontal or middle zone. In alternative embodiments, the cabinet-member end of the strut may be mounted directly to the side wall of the cabinet, e.g., by screws or other attachment means. Additionally, or alternatively, the drawer end of the strut may be mounted, or otherwise coupled directly to, the underside or back side of the drawer. In such embodiments, the cabinet member bracket and/or the drawer bracket would be eliminated, thereby resulting in fewer components, but also a more permanent attachment than would be provided when releasable coupling members (e.g., coupling members 136, 164) are used.

In addition, the cabinet member bracket and/or the drawer bracket may be modified in accordance with the specific type of cabinet member and/or drawer. Thus, as noted previously, the principles of the inventions herein may be applied to drawer systems with outer members having various cross-sectional configurations, such as, e.g., a generally "L" shaped configuration, or a generally asymmetrical "C" shaped configuration, wherein the two parallel portions of the "C" are of different lengths, etc.

Figure 20B:
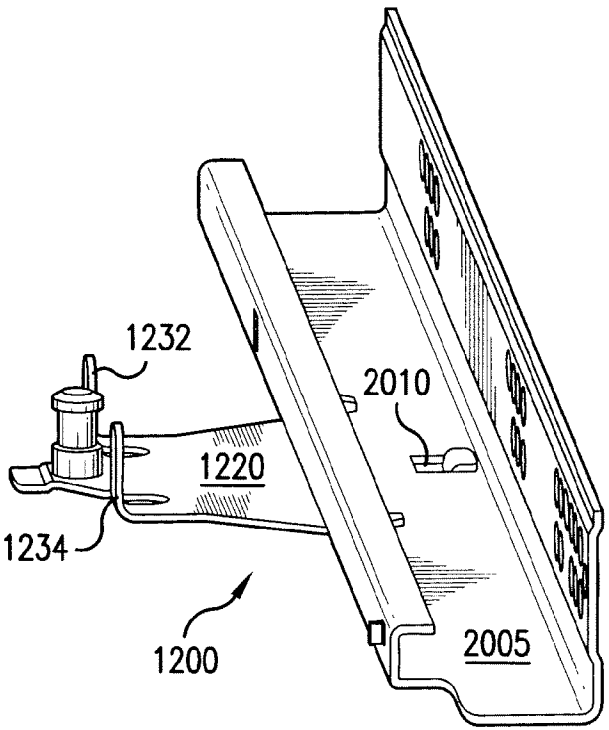
FIGS. 20A-20C show various views of a cabinet member and associated cabinet member bracket in accordance with an alternative embodiment of the present invention.
Figure 20A:
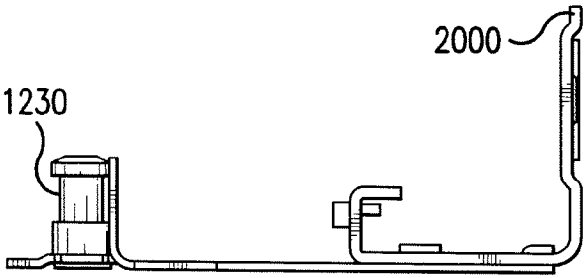
Figure 20C:
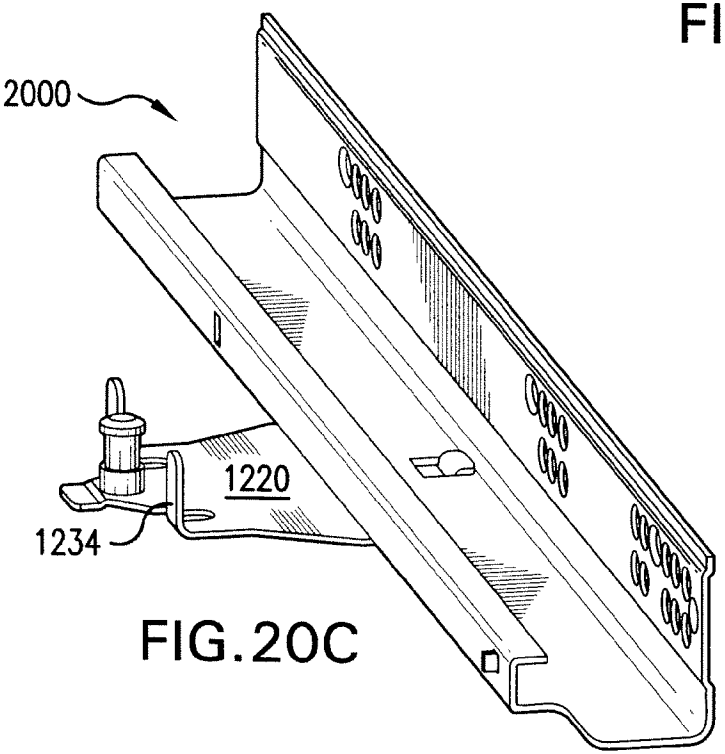
Figure 21:
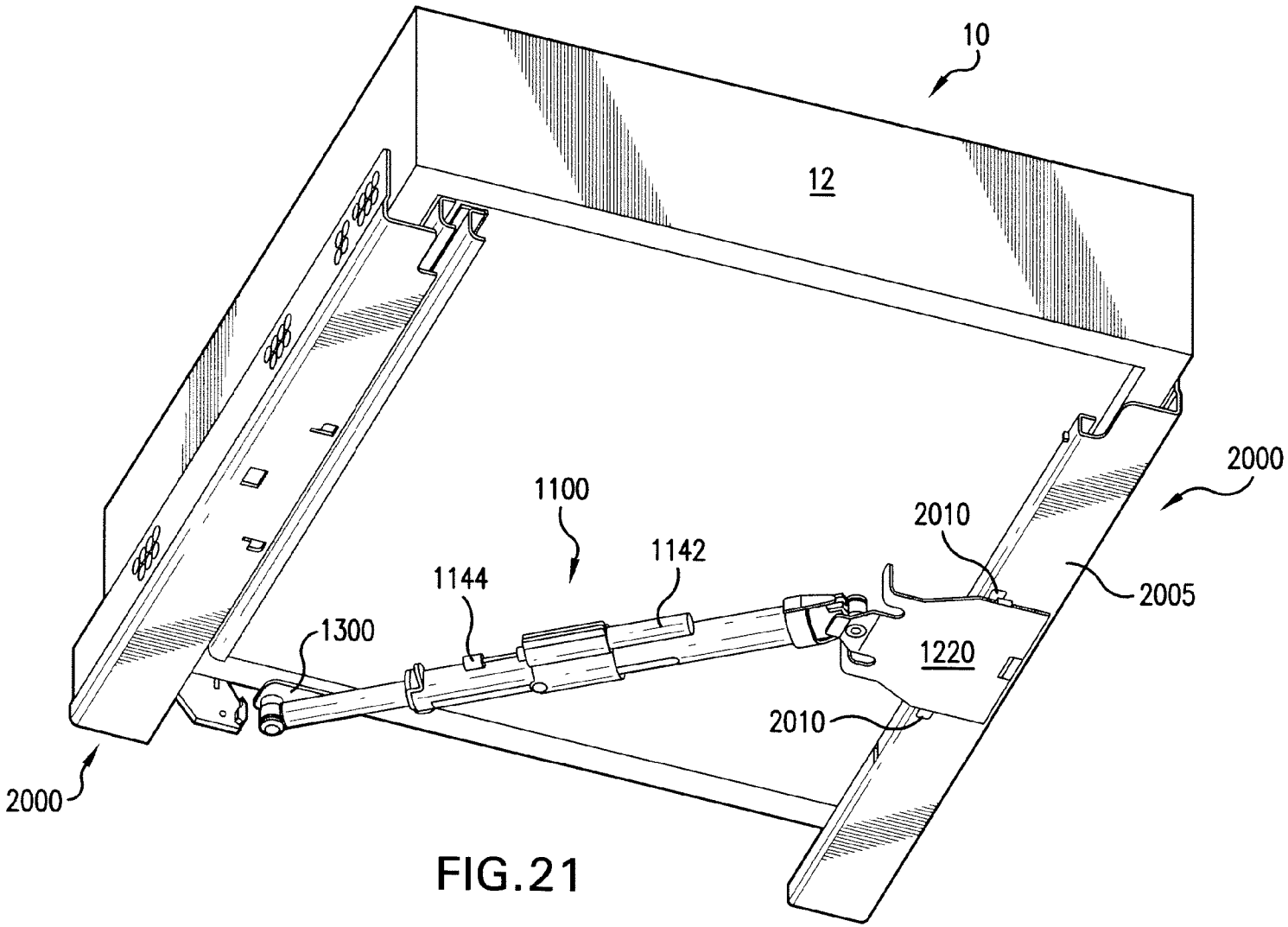
FIG. 21 is a bottom perspective view of a drawer system with the cabinet member and cabinet member bracket of FIGS. 20A-20C.

FIGS. 20-21, for example, show an embodiment in which the outer (or cabinet) member 2000 is substantially "L" shaped. Here, the cabinet member bracket 1200 includes a clevis pin 1230, and may include vertical tabs (or fingers) 1232, 1234, extending vertically upwards from a single horizontal surface 1220. In embodiments of the invention, the clevis pin 1230 may be, e.g., riveted to the surface 1220. In addition, the bracket 1200 may be, e.g., snapped into cut-out sections 2010 of the lower horizontal portion 2005 of the cabinet member 2000, or riveted, welded, or otherwise coupled to the cabinet member 2000. Thus, in FIG. 21, the strut 1100 having a damper 1140 is coupled between a drawer bracket 1300 and a cabinet member bracket 1200, the former being coupled to a drawer 10 and the latter being coupled to (an underside of) the cabinet member 2000.

It is noted that, while an air damper 1140 is shown in FIGS. 18 and 19, this is by way of example, and not limitation. Thus, a fluid damper (oil filled, for example), a rack and pinion (rotary damper) damping system, or a "reverse damper" may also be used to perform the damping function described herein.

Thus, with reference to FIGS. 22-38, in alternative embodiments, a "reverse damper" is added inside one or more of the assisted-motion systems discussed previously. In this context, the phrase "reverse damper" refers to a linear damper that provides a damping force when the damper's shaft is being pulled out, and a minimal (or no) damping force when the shaft is being pushed in. Thus, damping is caused by direct extraction of the linear shaft from the reverse damper.

Specifically, in one embodiment shown in FIGS. 22-38, similar to the struts 100, 1100 (see, e.g., FIGS. 6, 18, and 19), the strut 3100 includes an outer tube 3102 having a first end 3103 and a second end 3105, and receiving therein a spring 3190. At its first end 3103, the outer tube 3102 is detachably coupled to a cabinet bracket clevis 3160 having a coupling member 3164, and at its second end 3105, the outer tube 3102 is detachably coupled to a tube cap 3110.

The strut 3100 includes an integrated damping mechanism having a damper 3140 which is configured to soften, or dampen, the end of the assisted motion of the drawer in both the opening and closing directions. More specifically, working in conjunction with an inner tube 4102 that houses a second spring 4190, the damper 3140 serves to enhance the operation of the systems described herein by substantially reducing or eliminating any "bounce-back" and/or noise that may exist at the end of the assisted motion in each of the opening and closing directions. As shown, the damping mechanism is contained entirely within the strut 3100. In embodiments of the invention, the damper 3140 may be, e.g., an air damper or an oil damper.

Also housed within the strut 3100 is a cylindrical piston 3120, which includes a first longitudinal portion 3123, a second longitudinal portion 3125, and a third longitudinal portion 3127, with the second longitudinal portion having a relatively larger diameter than the first and third longitudinal portions. See, e.g., FIG. 25. As in prior embodiments, the transition between the first and second longitudinal portions defines a ledge 3156 upon which rests one end of the spring 3190. In one embodiment, at the free end of the third longitudinal portion 3127, the piston 3120 receives a rear portion 3132 of the drawer bracket clevis 3130.

Figure 22:
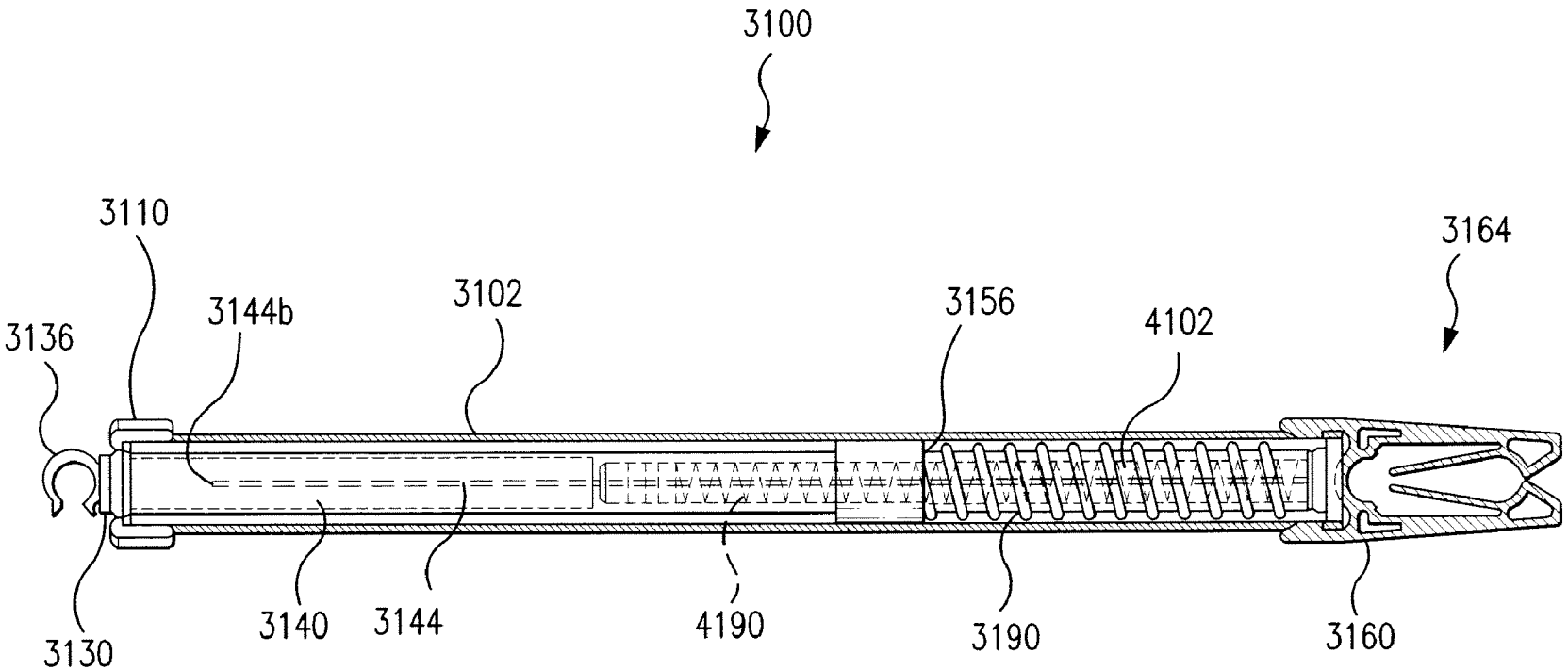
FIG. 22 is a perspective view of a strut in a retracted position in accordance with an alternative embodiment of the present invention.
Figure 23:
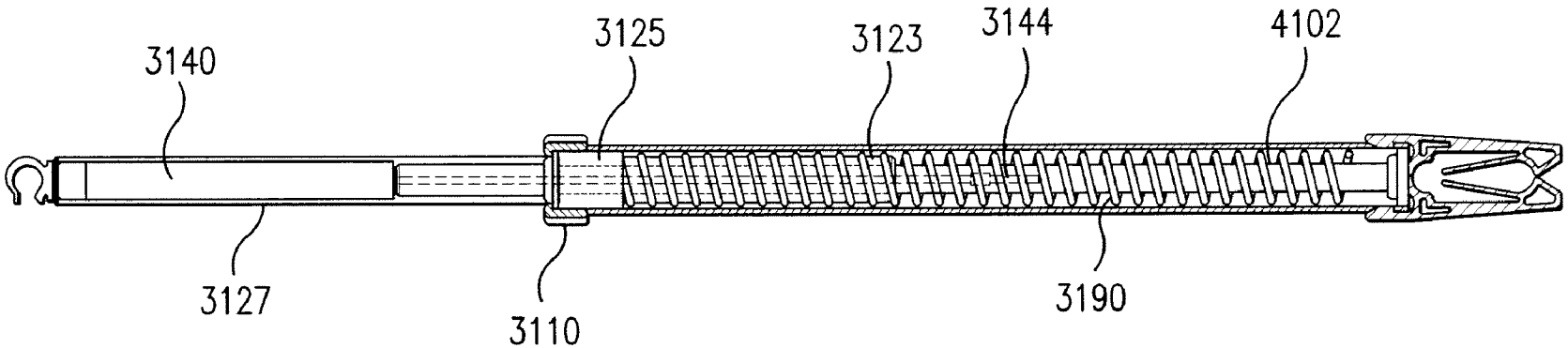
FIG. 23 is a perspective view of the strut of FIG. 22 in the extended position.

FIG. 22 shows the strut 3100 in a fully retracted position, while FIG. 23 shows the strut 3100 in a fully extended position. As shown, the damper 3140 is disposed within the piston's third longitudinal portion 3127, registering against an internal push-on retaining ring 3149 (shown in FIGS. 30 and 36D), and includes a damper shaft 3144. In order to function properly, the damping mechanism must be configured such that, when the strut 3100 moves from the fully-extended position (i.e., drawer fully open or fully closed) to the fully-retracted position (i.e., neutral region in which the drawer is between the fully-closed and fully-open positions), the damper shaft 3144 retracts first. On the other hand, when the strut 3100 moves from the fully-retracted position to the fully-extended position, the damper shaft 3144 should be extended last, thereby slowing the strut travel at each end (i.e., drawer opening and drawer closing) of the assisted motion.

Figure 30A:
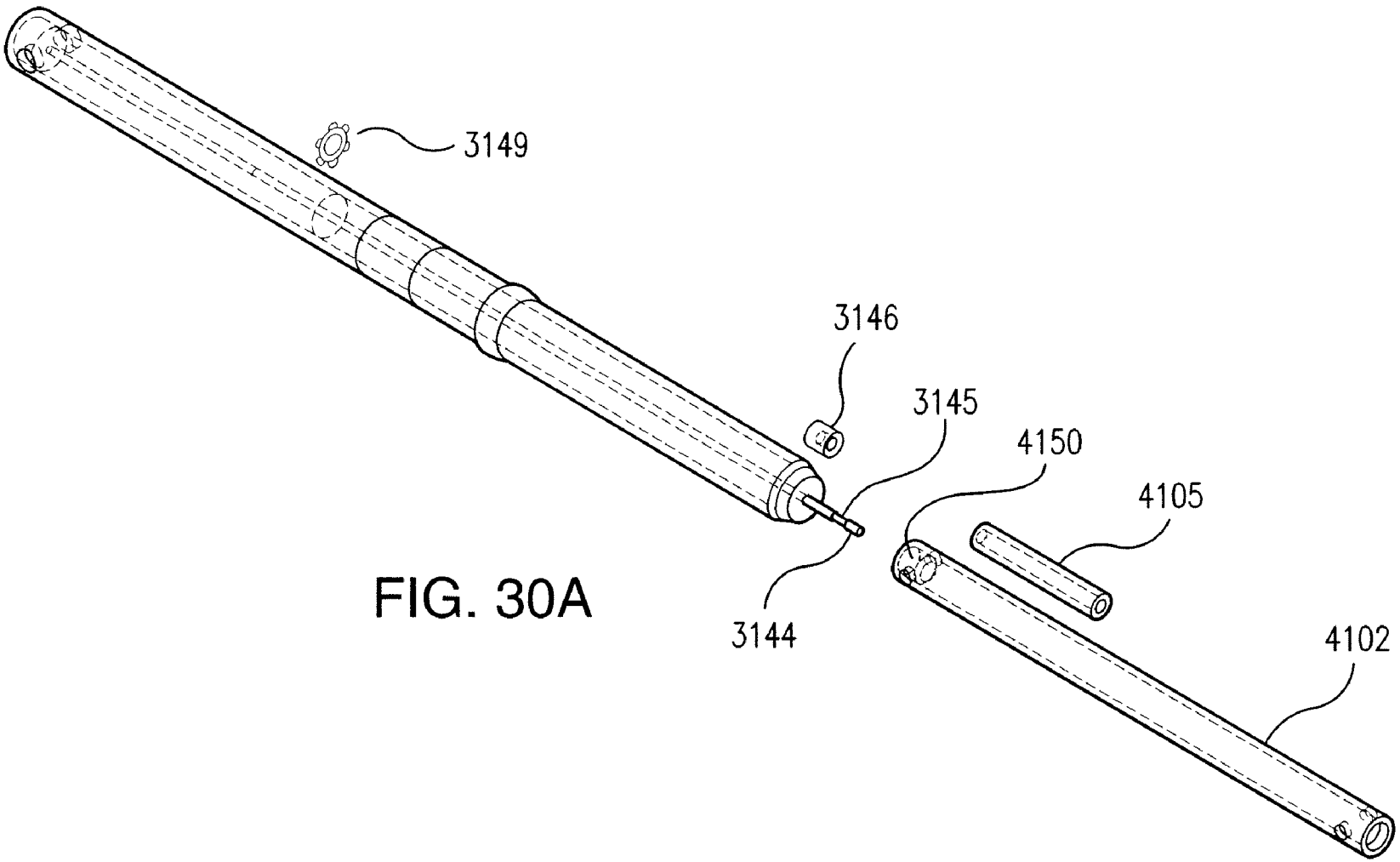
FIG. 30A-30C show perspective views of a sub-assembly including a damping mechanism in accordance with an embodiment of the present invention.
Figure 30B:
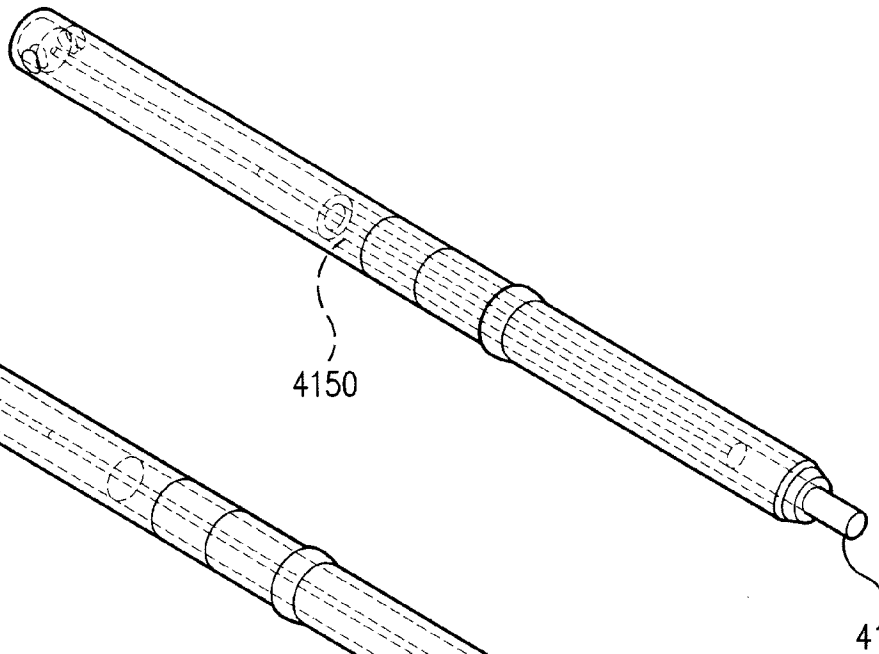
Figure 30C:
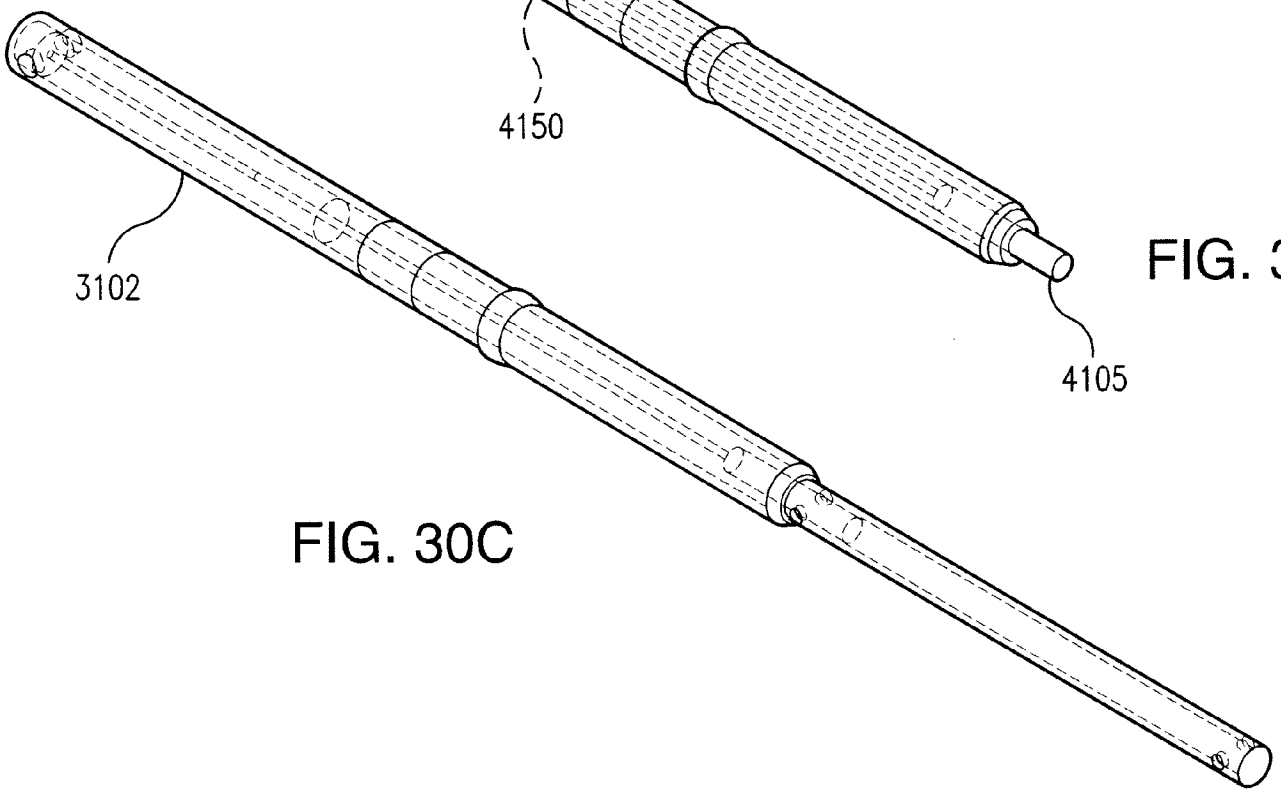
Figure 31B:
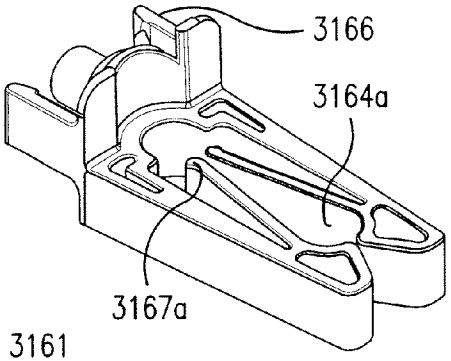
FIGS. 31A-31E show various views of a cabinet bracket clevis in accordance with an alternative embodiment of the present invention.
Figure 31C:
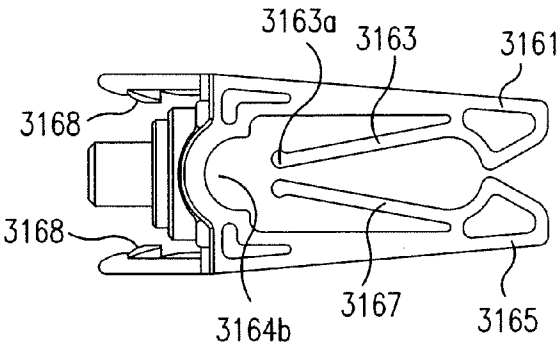
Figure 31E:
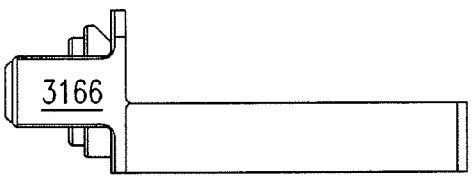
Figure 31A:
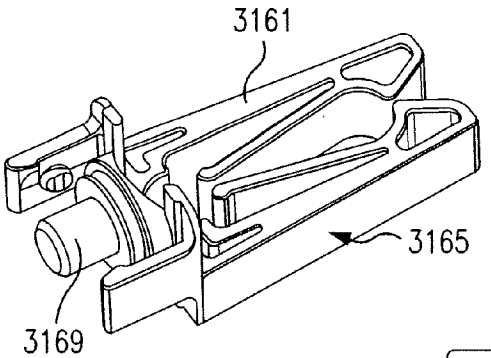
Figure 31D:
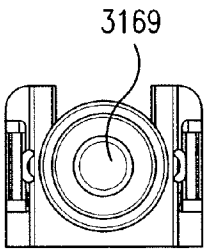

In this regard, the damping mechanism also includes an inner tube 4102 that extends axially through the first spring 3190. The inner tube 4102, in turn, houses a second spring 4190. The second spring 4190 is disposed between the cabinet bracket clevis 3160 and a spring seat 3146 which is slidably coupled to the damper shaft 3144 proximate a first (free) end 3144*a* thereof. More specifically, as shown in FIGS. 29 and 30, proximate its free end 3144*a*, the damper shaft 3111 includes a radial indentation 3145 that engages the spring seat 3146. Thus, in operation, once engaged, the spring seat 3146 prevents further withdrawal of the shaft 3144 through the spring seat and towards the strut's second end (i.e., towards the outer tube's second end 3105). As shown in FIG. 30, in embodiments of the invention, the spring seat 3146 may be a machined or cold head feature or formed fastener.

At their respective first ends, i.e., the right-hand side of the diagrams in FIGS. 22-25, the inner tube 4102, the first spring 3190, and the second spring 4190 are disposed on a rear side of the cabinet bracket clevis 3160. More specifically, on a portion of the cabinet bracket clevis opposite the coupling member 3164, the cabinet bracket clevis includes a longitudinal stud, or post, 3169, 4169 that receives thereon the first end of the inner tube 4102. At its opposite end, the inner tube 4102 is coupled to a cap 4150 which, in turn, includes an axial opening 4153. See FIGS. 27-28.

With the above-described construction, the strut 3100 is configured such that, as the first spring 3190 expands, causing the third longitudinal portion 3127 of the piston 3120 to exit the second end 3105 of the outer tube 3102, the piston's first longitudinal portion 3123 slides over the inner tube 4102 and away from the strut's first end 3103. Thus, as the strut 3100 begins to move from the fully-retracted position shown in FIG. 22, the damper 3140 and the damper shaft 3144 move in concert with the piston 3120, with the damper shaft 3144 sliding through the spring seat 3146. However, the spring seat 3146 is dimensioned such that it does not pass through the axial opening 4153 of the inner tube's cap 4150. Therefore, once the spring seat 3146 has been engaged by the damper shaft 3144 as previously described, as the first spring 3190 expands further, and the piston 3120 continues to slide through the strut's second end, the damper shaft's second end 3144*b*—i.e., the end opposite the free end 3144*a*—is pulled out of the damper 3140. As discussed previously, the withdrawal of the shaft's second end from the damper dampens the piston's continued outward movement, until the position shown in FIG. 23 is reached.

As noted, the above description relates to a "reverse damper". Nevertheless, in embodiments of the invention, a "forward damper" may be used, wherein, when the strut moves from the fully-extended position (i.e., drawer fully open or fully closed) to the fully-retracted position (i.e., neutral region in which the drawer is between the fully-closed and fully-open positions), the damper shaft extends first. On the other hand, when the strut moves from the fully-retracted position to the fully-extended position, the damper shaft retracts last, thereby slowing the strut travel at each end (i.e., drawer opening and drawer closing) of the assisted motion.

Figure 24:
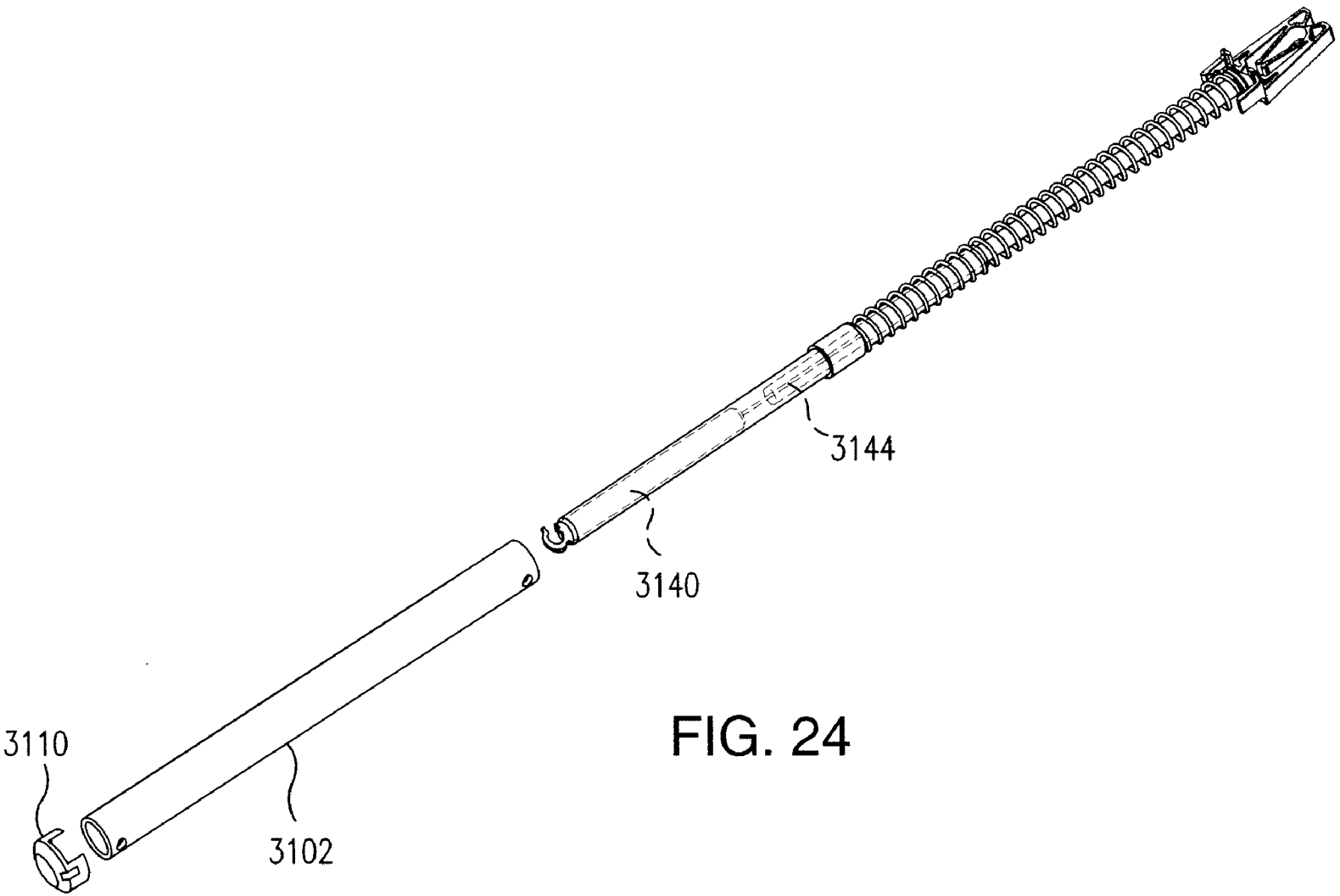
FIG. 24 is an exploded view of the strut shown in FIG. 22.
Figure 26A:
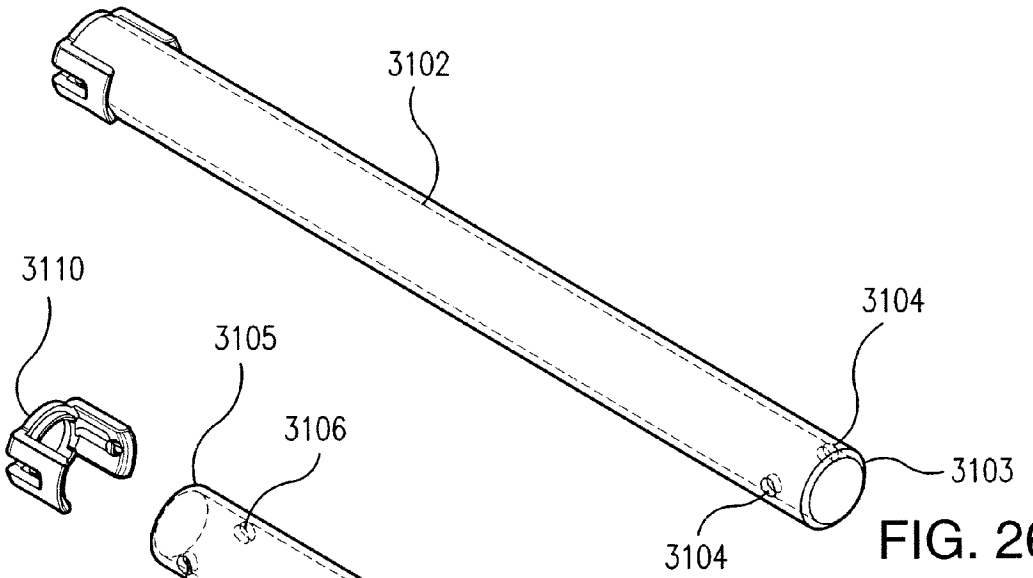
FIGS. 26A and 26B are perspective views of an outer hollow member in accordance with an embodiment of the present invention.
Figure 26B:
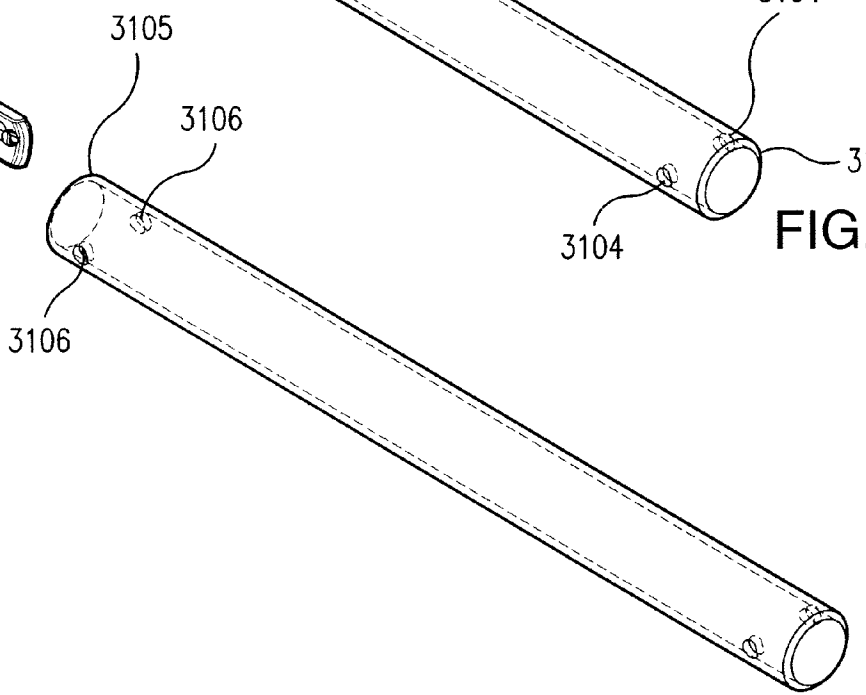
Figure 27A:
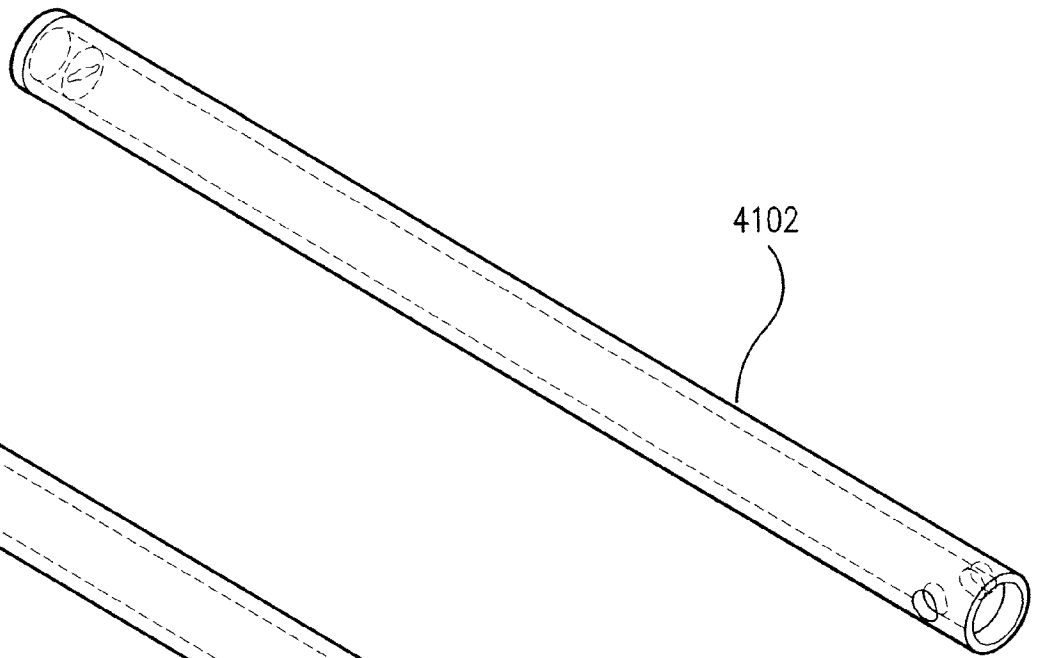
FIGS. 27A and 27B are perspective views of an inner hollow member in accordance with an embodiment of the present invention.
Figure 27B:
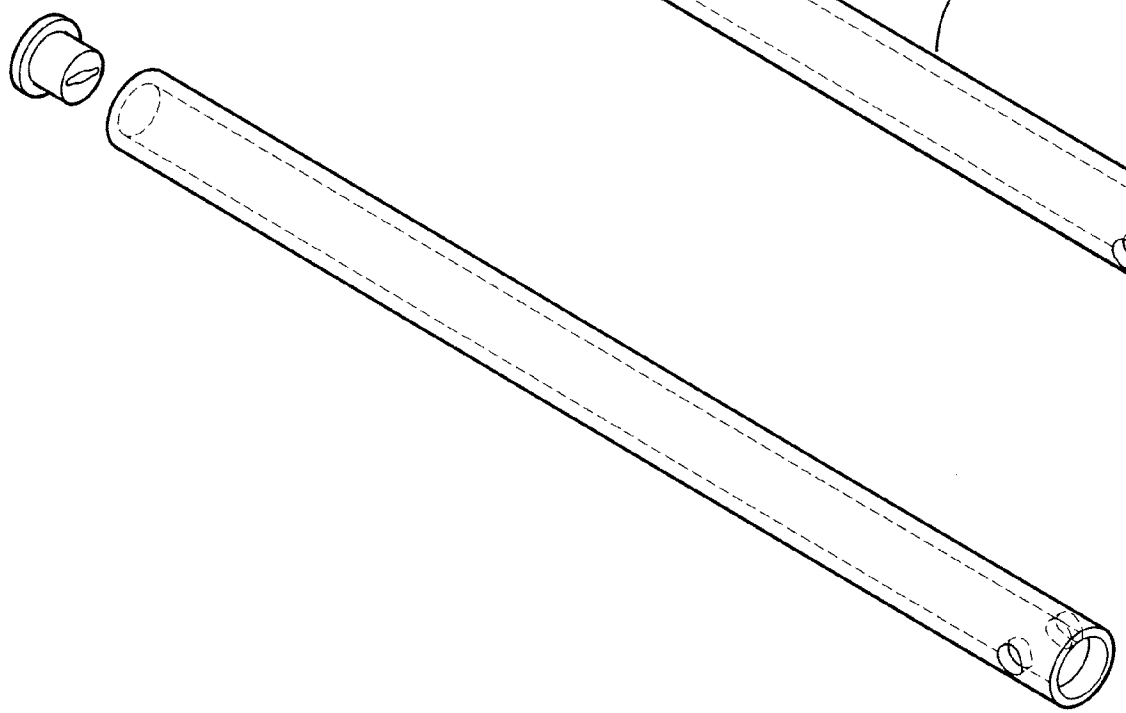
Figure 28:
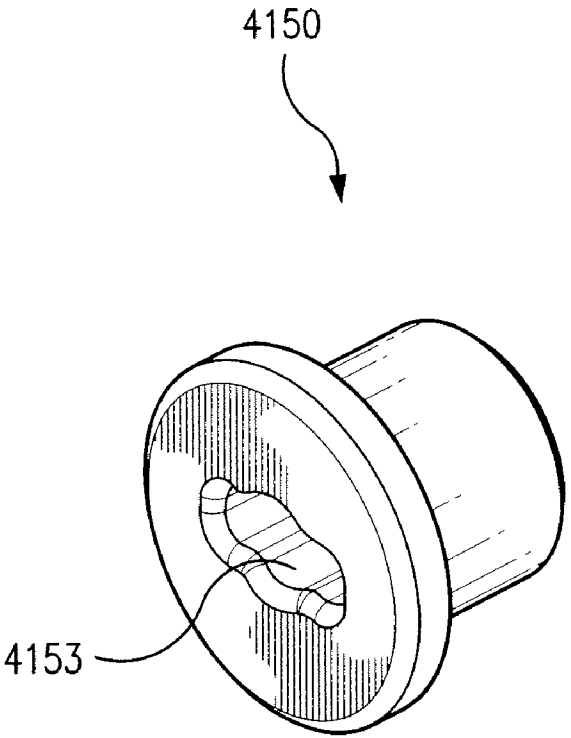
FIG. 28 is a perspective view of the cap shown in FIGS. 27A and 27B.
Figure 29A:
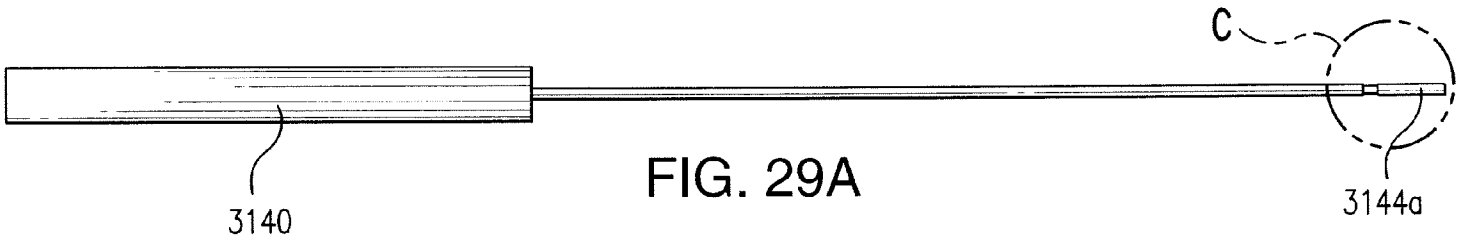
FIGS. 29A-29C show plan views of a damper in accordance with an embodiment of the present invention.
Figure 29B:
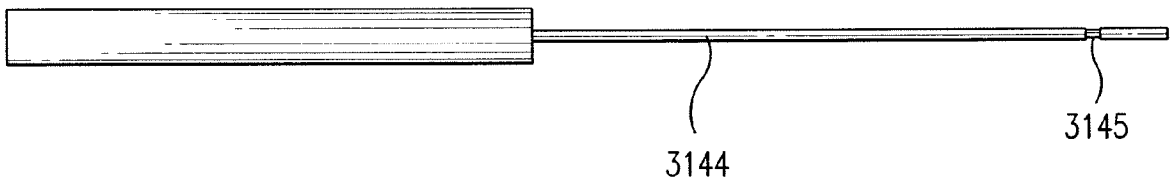
Figure 29D:
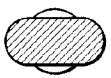
FIG. 29D shows a sectional view along the line E-E of FIG. 29C.
Figure 29C:
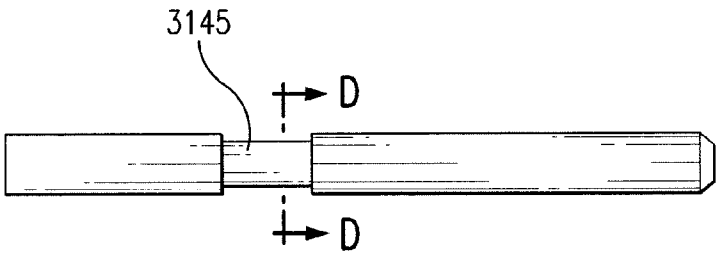
Figure 36B:
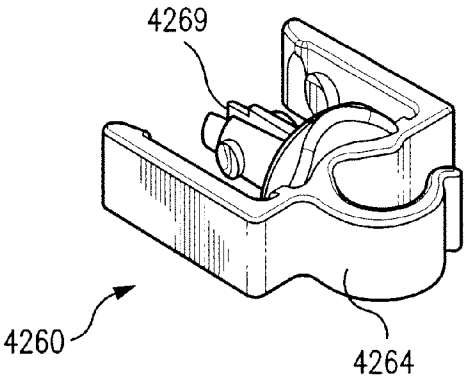
FIG. 36B shows a perspective view of a cabinet bracket clevis in accordance with another alternative embodiment of the present invention.
Figure 36D:
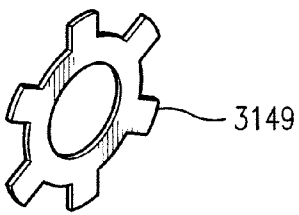
FIG. 36D shows a perspective view of an internal ring for use with an embodiment of the present invention.
Figure 36A:
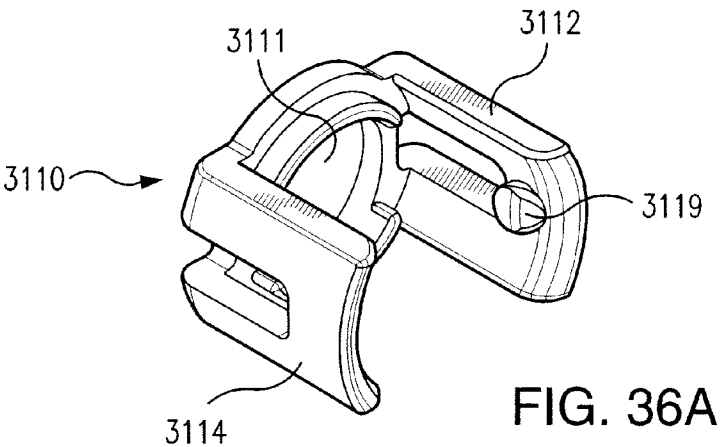
FIG. 36A shows a perspective view of an end cap in accordance with an embodiment of the present invention.

As shown in FIGS. 24, 26, and 36A, and as with previously-described embodiments, at its end 3105, the outer tube 3102 is coupled to a tube cap 3110 having a first extension arm 3112 and an opposing second extension arm 3114. However, each of the extension arms 3112, 3114 now has a respective transverse protrusion 3119. Thus, when assembled, the tube cap 3110 is placed on the end 3105 of outer tube 3102, with one of the apertures 3106 of the outer tube 3102 being aligned with the respective protrusion 3119 of one of the arms 3112, 3114, the other aperture 3106 being aligned with the protrusion 3119 of the second one of the arms 3112, 3114, and the coupling member 3136 of the drawer bracket clevis 3130 protruding through the orifice 3111.

Also, as with the embodiment of FIGS. 18 and 19, the generally U-shaped coupling member 136 of the drawer bracket clevis 130 (see, e.g., FIG. 7) is rotated, i.e., from an axial direction with respect to the strut, to a perpendicular direction, such that the assembly to the drawer clevis pin is in a rotational arc, swinging the strut assembly into position and snapping the coupling member 3136 to the drawer clevis pin from the side. This side directional connection helps eliminate inadvertent disengagement of the strut from the drawer at the end of the damped travel. The structure of the coupling member 3136 of the drawer bracket clevis 3130, therefore, is substantially C-shaped, quite similar to that of the coupling member 1136 of the drawer bracket clevis 1160.

Figure 32B:
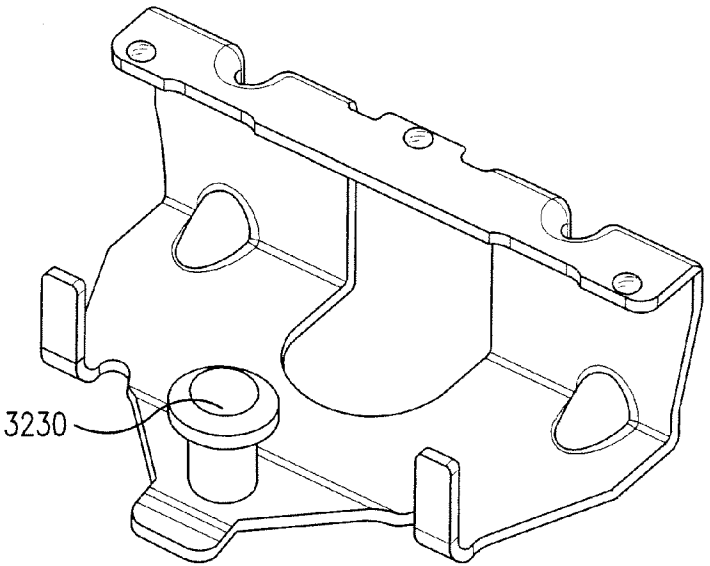
FIGS. 32A-32C show various views of a cabinet member bracket in accordance with an alternative embodiment of the present invention.
Figure 32C:
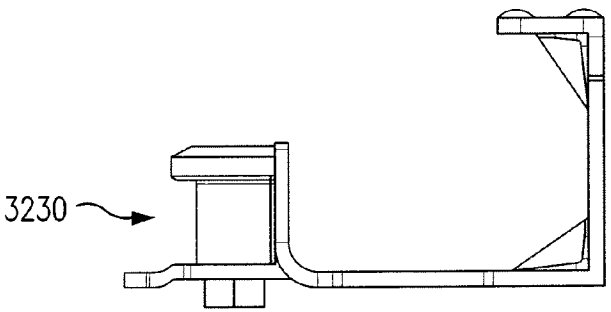
Figure 32A:
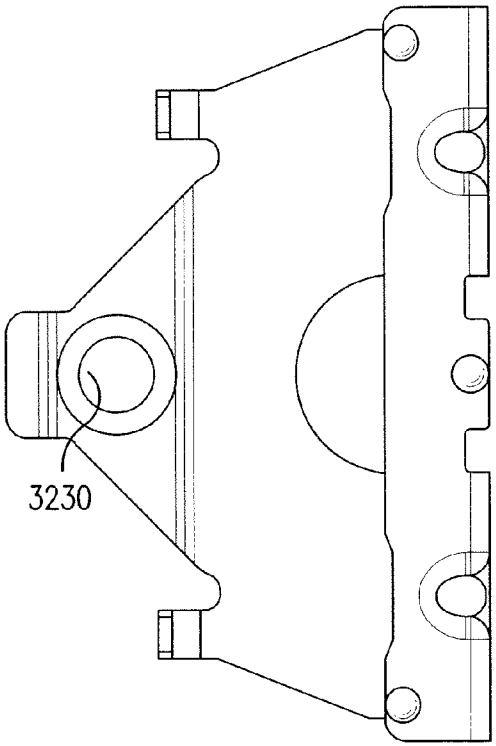
Figure 33B:
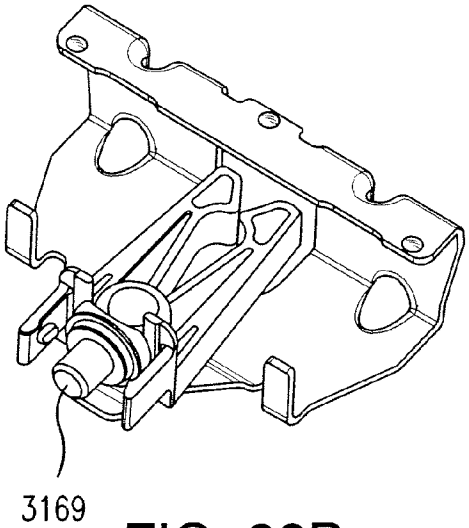
FIGS. 33A-33D show various views of the cabinet bracket clevis of FIG. 31 coupled to the cabinet member bracket shown in FIG. 32.
Figure 33D:
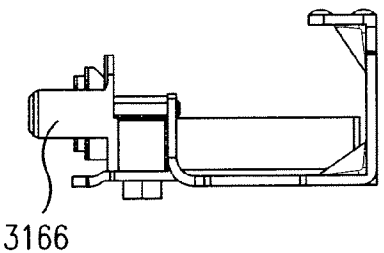
Figure 33A:
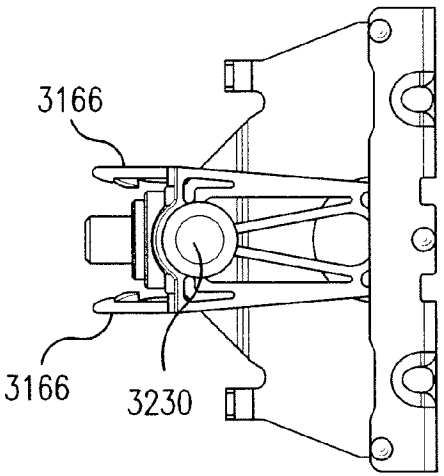
Figure 33C:
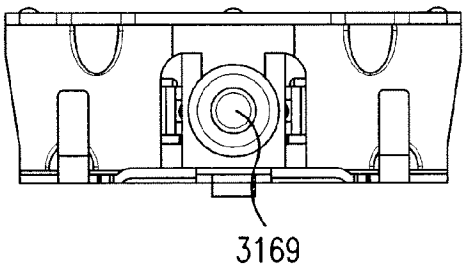
Figure 34B:
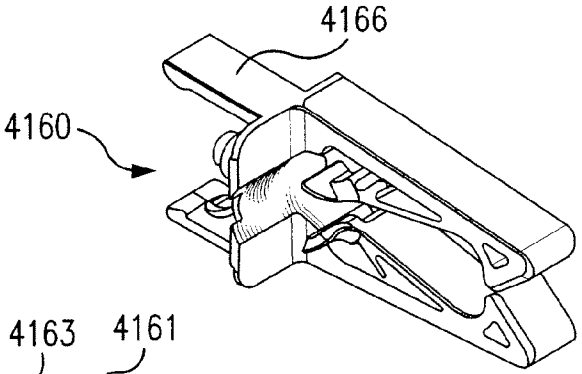
FIGS. 34A-34E show various views of a cabinet bracket clevis in accordance with another alternative embodiment of the present invention.
Figure 34C:
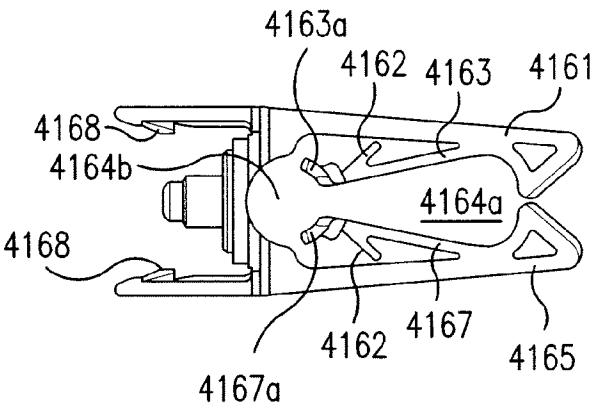
Figure 34E:
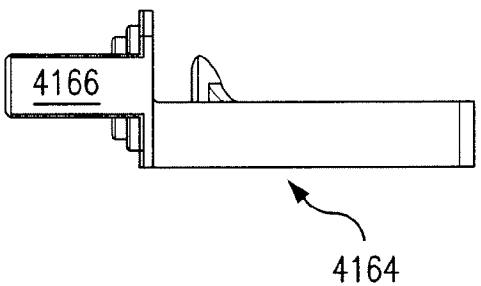
Figure 34A:
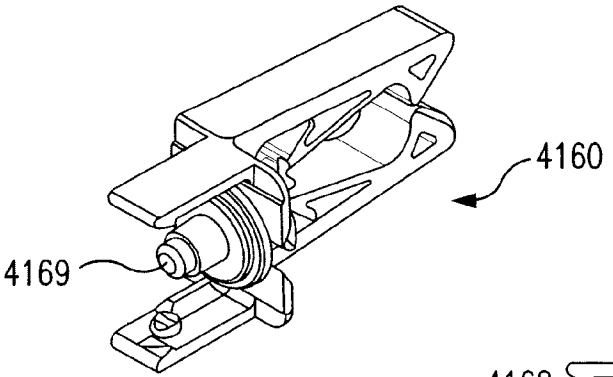
Figure 34D:
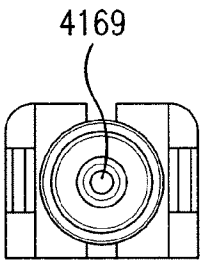
Figure 35C:
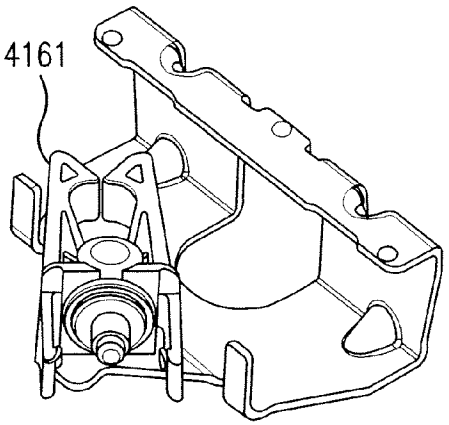
FIGS. 35A-35E show various views of the cabinet bracket clevis of FIG. 34 coupled to a cabinet member bracket.
Figure 35B:
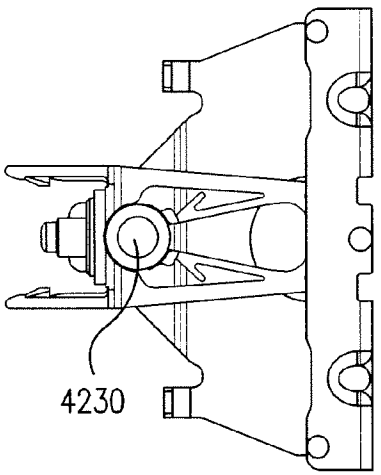
Figure 35E:
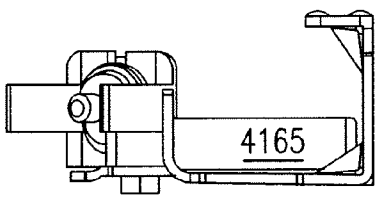
Figure 35A:
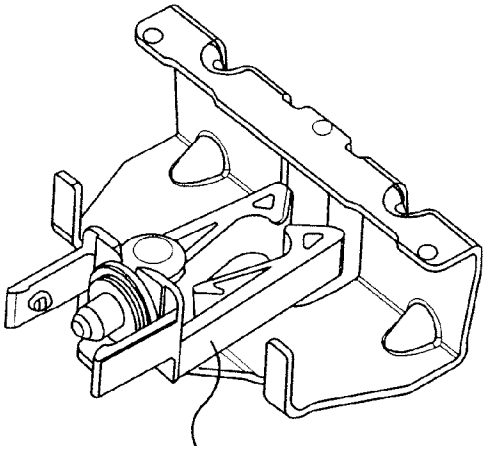
Figure 35D:
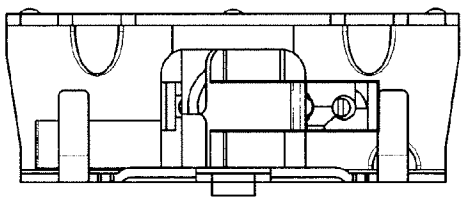

In an embodiment of the invention, the cabinet bracket clevis 3160 may include a fork-shaped coupling member 3164, 4164. In the embodiment shown in FIG. 31, the coupling member 3164 includes opposing flexible fingers 3161, 3165, each of which has a respective molded-in spring 3163, 3167. With reference to FIGS. 32 and 33, in an embodiment of the invention, the clevis pin 3230 of the cabinet member bracket is wider proximate its top end, and then has a uniform diameter as it extends to the bracket's lower horizontal surface. Here, the coupling member 3164 mates with the clevis pin 3230 by pressing the former and the latter towards one another.

As the clevis pin contacts the fingers 3161, 3165, the latter flex outwards to allow the pin to become disposed in a first "circle" 3164*a*. While the clevis pin is in this first circle, it can be disengaged from the coupling member 3164 with a minimal pulling force. However, if the clevis pin continues to be pushed in, it becomes lodged in a second "circle" 3164*b*, where it is rotatably held in place by extensions 3163*a*, 3167*a* of the springs 3163, 3167, such that the strut 3100 will not become disengaged from the cabinet member bracket (and, therefore, from the cabinet) with a simple outward pull on the drawer occurring during normal use. It is noted that the coupling member 3164 also includes protrusions 3168 on each of opposing arms 3166 that, in one embodiment, may be received within apertures 3104 proximate the strut's first end 3103, thereby removably coupling the cabinet member clevis 3160 to the strut 3100. See, e.g., FIGS. 22 and 26. As shown in FIG. 31, on a portion opposite the coupling member 3164, the cabinet bracket clevis 3160 includes a longitudinal stud, or post, 3169 to receive thereon an end of the inner tube 4102.

In an alternative embodiment, shown in FIGS. 34-35, the clevis pin 4230 of the cabinet member bracket is wider proximate its upper and lower ends, and narrower in the middle section (i.e., similar to a spindle), and is substantially identical to the clevis pin shown, e.g., in FIGS. 14A-14D. Here, the clevis pin 4230 mates with a fork-shaped coupling member 4164, including flexible fingers 4161, 4165, each of which has a respective spring 4163, 4167. Each of the latter, in turn, includes a flex-stop 4162, as well as a relatively larger extension 4163*a*, 4167*a*. In addition, similar to the coupling member 3164, coupling member 4164 includes a first circle 4164*a*, a second circle 4164*b*, and opposing arms 4166 each having a protrusion 4168 for removably coupling the cabinet bracket clevis 4160 to the strut 3100. As shown in FIG. 34, on a portion opposite the coupling member 4164, the cabinet bracket clevis 4160 includes a longitudinal stud, or post, 4169 to receive thereon an end of the inner tube 4102.

FIG. 36B shows yet another alternative embodiment of a cabinet bracket clevis 4260, having a coupling member 4264. The cabinet bracket clevis 4264 is similar to, e.g., cabinet bracket clevis 1164 shown in FIGS. 18 and 19. However, the former now has a longitudinal stud 4269 to receive thereon an end of the inner tube 4102. In addition, the cabinet bracket clevis 4264 may be coupled to the outer tube 3102 without the need for a locking clip 1170.

Figure 36C:
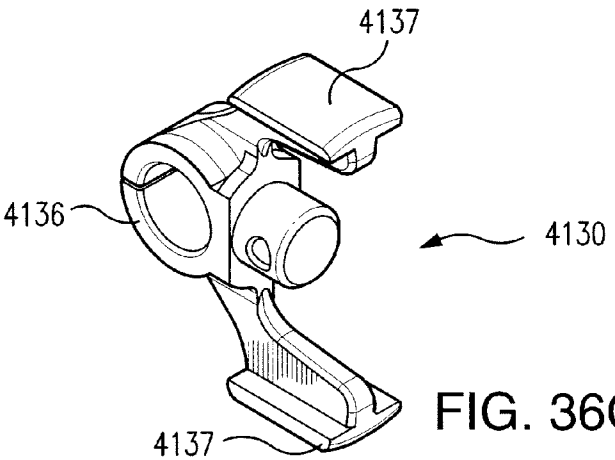
FIG. 36C shows a perspective view of a drawer bracket clevis in accordance with another alternative embodiment of the present invention.

FIG. 36C shows an alternative embodiment of the drawer bracket clevis 4130 having a coupling portion 4136. As shown, the coupling portion 4136 has a clamshell configuration, including opposing elastic handle members 4137 such that, when the handles are pressed toward each other, the clamshell opens to receive a drawer bracket's clevis pin. The clamshell configuration allows the strut 3100 to be connected to the drawer bracket clevis pin—and, therefore, to the drawer—until manually removed. In this way, when it is desired to remove the drawer from the cabinet, it is the cabinet bracket clevis 4260, and not the drawer bracket clevis 4130, that is self-released when the drawer is pulled out with a relatively large force.

As has been noted previously, embodiments of the invention may be used in association with standard slides ranging from, e.g., 10 to 28 inches in length. Various strut sizes may be provided in order to cover the range of strokes for the above-mentioned lengths, while fitting in specific narrow drawers. In addition, drawer width limitations as related to drawer slide length are predicated on the available cross space when the strut rotates into the middle zone of action, during either the opening or the closing motion. Thus, in embodiments of the invention, various "spacers" may be used to provide the needed stroke and accommodate various drawer widths and slide lengths.

Figure 25:
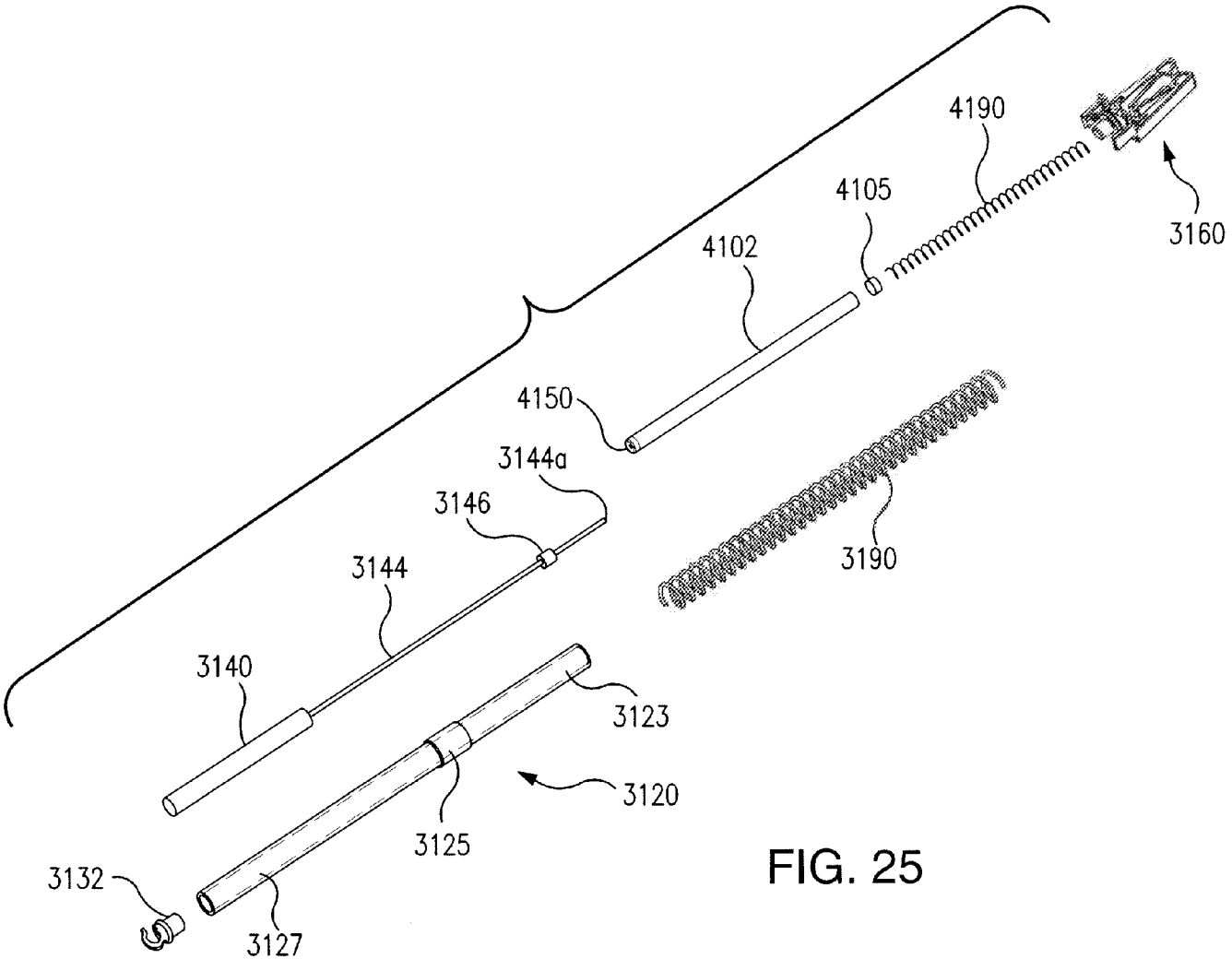
FIG. 25 is an exploded view of a sub-assembly including a damping mechanism in accordance with an embodiment of the present invention.

Specifically, as shown in FIGS. 25 and 30, in embodiments of the invention, an internal spacer 4105 of variable length may be placed between the cap 4150 of the inner tube 4102 and the second spring 4190. In addition, as shown in FIGS. 37 and 38, rather than the larger-diameter second portion 3125, the piston 4120 may include radial indentations (or grooves) 4121, 4123, 4125 spaced longitudinally apart around the periphery thereof. Depending upon the stroke that is needed, an external spacer 4127 may be placed adjacent one of the above-mentioned radial indentations. An external retaining ring 4128 (see FIG. 38) is then disposed in one of the indentations 4121, 4123, 4125 to allow positioning of the external spacer 4127 on the piston 4120.

Figure 37A:
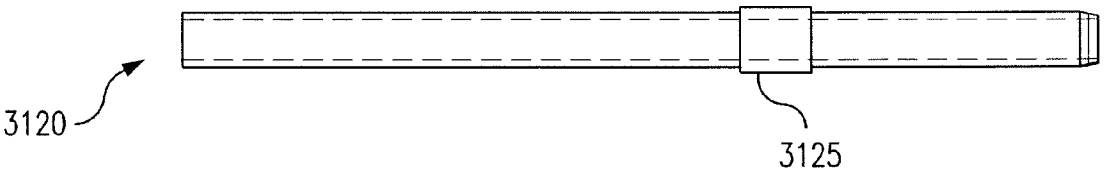
FIGS. 37A-37E show plan views of pistons in accordance with embodiments of the present invention.
Figure 37B:
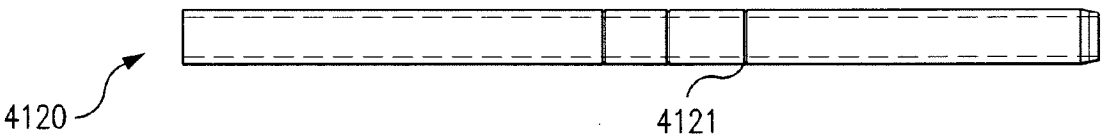
Figure 37C:
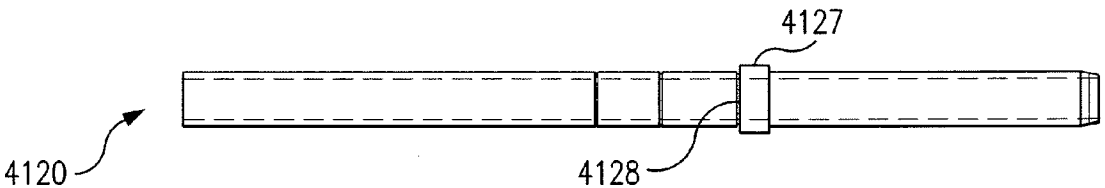
Figure 37D:
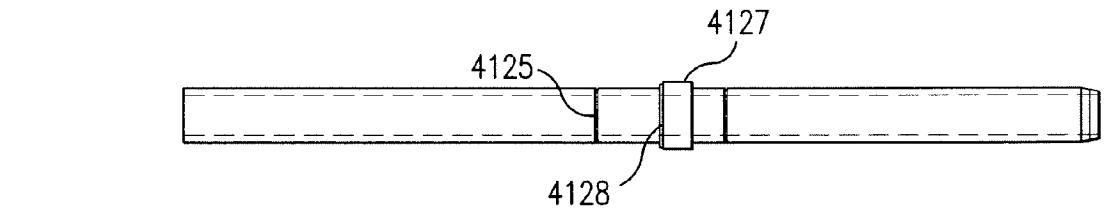
Figure 38:
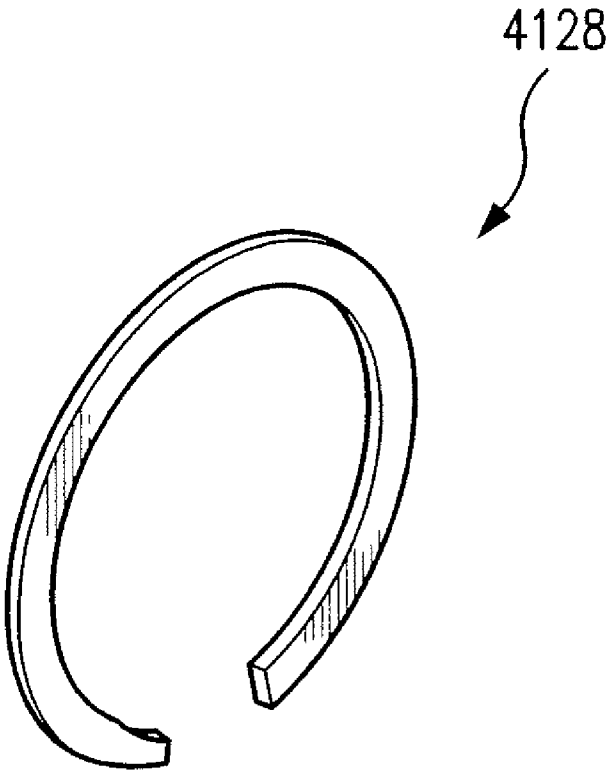
FIG. 38 shows an external retaining ring for use in conjunction with one or more of the pistons shown in FIG. 37.

Thus, FIG. 37C, for example, shows an embodiment in which a retaining ring 4128 is placed in indentation 4121 to position the external spacer 4127 adjacent the indentation 4121. In this embodiment, the above combination may not require the use of an internal spacer 4105 at all. FIG. 37D, on the other hand, shows an embodiment in which a retaining ring 4128 is placed in the middle indentation 4123 to position the external spacer 4127 adjacent the indentation 4123. In this embodiment, a relatively short internal spacer 4105 is used in the internal tube 4102.

Figure 37E:
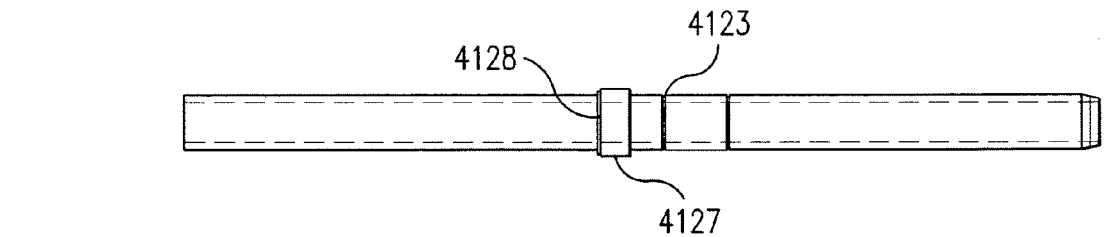

Finally, in FIG. 37E, a retaining ring 4128 is placed in the indentation 4125 to position the external spacer 4127 adjacent the indentation 4125, which may also require the use of a relatively longer internal spacer 4105 in the internal tube 4102. Thus, the above-mentioned combinations allow the construction of several strut assemblies to accommodate different drawer/slide length and width configurations by using a common piston component and design.

The embodiments discussed above in connection with FIGS. 22-38 advantageously provide a sub-assembly—including, e.g., the piston 3120, the damper 3140, the first spring 3190, the inner tube 4102, and the second spring 4190—that is a self-contained unit, and can be pre-assembled first, and then inserted into an outer tube 3102. Consequently, the damper is also invisible, as it resides inside the outer tube. In addition, it may be necessary to have, e.g., a f-inch overtravel (or extension) of the strut assembly when the drawer is slowly pulled-out/pushed-in during drawer removal/installation. To this end, the connector between the strut and the drawer (e.g., the drawer bracket clevis 3130) may be visible and accessible underneath the drawer for manually release and/or disconnection.

Moreover, during normal operation, the strut 3100 is securely, yet releasably, coupled at both ends. As such, whenever there is an impact, such as a hard push or pull on the drawer, the heavy damping force will not cause accidental self-release of the drawer bracket clevis from the clevis pin. Rather, when, for example, the drawer is removed with a heavy pull-out force, the strut is automatically released from the cabinet bracket clevis pin 3230, 4230, and consequently, from the cabinet itself, without the need to manually disconnect the connector at the drawer side and without damaging any components.

It is understood that one or more of the components and/or sub-components described herein in connection with a specific embodiment may be used in conjunction with one or more of the components and/or sub-components described in connection with a different specific embodiment. Thus, while the description above refers to particular embodiments of the present invention, it will be understood that many modifications may be made without departing from the spirit and scope thereof.

What is claimed is:

1. A system, in combination with a pull-out component and an associated housing, for assisting the opening and closing movement of the pull-out component relative to the housing with an integrated damping mechanism, said housing having a slide member coupled to an interior wall thereof, and said pull-out component being linearly slidable into and out of said housing, the system comprising:

a first bracket coupled to said slide member of the housing;

a second bracket coupled proximate a rear end of said pull-out component;

a strut having a first end coupled to the first bracket and an opposing second end coupled to the second bracket, said strut comprising:

an outer straight hollow member having opposing first and second ends;

a first spring having opposing first and second ends and being housed within said straight hollow member; and a cylindrical piston having first, second, and third longitudinal portions, wherein the first longitudinal portion extends axially through the spring's second end, the second longitudinal portion extends axially outside of the spring's second end, and the third longitudinal portion extends from the second longitudinal portion in a direction opposite that of the first longitudinal portion so as to translate axially through said second end of the outer straight hollow member, said second longitudinal portion having a larger diameter than said first and third longitudinal portions; and a damping mechanism contained entirely within said strut and including a damper that counteracts the force exerted by the first spring on the cylindrical piston to dampen the movement of the pull-out component from a neutral region towards a fully-open position and from the neutral region towards a fully-closed position;

wherein said housing is a cabinet, and said slide member is a cabinet slide member;

wherein the first bracket includes a lower horizontal surface and a clevis pin extending vertically upwards from said lower horizontal surface;

wherein the strut further includes a cabinet bracket clevis, said cabinet bracket clevis being coupled to said first end of the outer hollow member and being configured to pivotally engage said clevis pin;

wherein the cabinet bracket clevis includes a substantially C-shaped coupling member and the first bracket's clevis pin is configured to snap into said cabinet bracket clevis; and wherein said first end of the first spring is disposed on a portion of said cabinet bracket clevis opposite said coupling member.

2. The system of claim 1, wherein the cabinet bracket clevis detachably engages the clevis pin.

3. The system of claim 1, wherein the cabinet bracket clevis is detachably coupled to said outer hollow member via a pin.

4. The system of claim 1, wherein the first bracket's lower horizontal surface is configured to be coupled to the cabinet slide member.

5. The system of claim 1, wherein the first bracket further includes an upper horizontal surface and a vertical spine connecting said lower and upper horizontal surfaces, said upper horizontal surface being configured to be coupled to said cabinet slide member.

6. The system of claim 1, wherein the cabinet bracket clevis includes a substantially fork-shaped coupling member having opposing elastic fingers, said fingers being configured to releasably engage the first bracket's clevis pin.

7. The system of claim 6, wherein the coupling member is configured to pivot about the clevis pin during linear opening and closing movement of the pull-out component.

8. The system of claim 1, wherein the first spring is a compression spring.

9. The system of claim 1, wherein the second bracket includes a horizontal section, a vertical section, and a clevis pin extending vertically downwards from an undersurface of said horizontal section.

10. The system of claim 9, wherein the vertical section includes transverse attachment holes for coupling the second bracket to a rear end of the pull-out component.

11. The system of claim 1, wherein the pull-out component is a drawer having a rear panel at a rear end thereof, and the piston's third longitudinal portion receives a drawer bracket clevis at a free end thereof.

12. The system of claim 11, wherein the second bracket includes a horizontal section, a vertical section that is configured to be attached to the drawer's rear panel, and a clevis pin extending vertically downwards from an undersurface of the horizontal section, and wherein the drawer bracket clevis includes a substantially C-shaped coupling portion configured to releasably engage said second bracket's clevis pin.

13. The system of claim 12, wherein the coupling portion of the drawer bracket clevis is configured to pivot about the second bracket's clevis pin during linear opening and closing movement of the drawer.

14. The system of claim 11, wherein the second bracket includes a horizontal section and a clevis pin extending vertically downwards from an undersurface of said horizontal section, and wherein the drawer bracket clevis includes a clamshell coupling portion configured to releasably engage said second bracket's clevis pin.

15. The system of claim 1, the strut further including a cap, said cap having an axial orifice and being coupled to said second end of the outer hollow member.

16. The system of claim 15, wherein said third longitudinal portion of the cylindrical piston is configured to translate through said axial orifice along the majority of the length thereof.

17. The system of claim 15, wherein the cap is detachably coupled to said outer hollow member via a pin.

18. The system of claim 1, wherein the first bracket is coupled to the slide member of the housing so as to be positioned thereon at approximately a longitudinal midpoint of the pull-out component travel.

19. The system of claim 1, wherein the strut is oriented such that, when the pull-out component is in a middle region of travel, the strut is substantially perpendicular to the slide member of the housing.

20. The system of claim 1, wherein the damper is an air damper.

21. A system, in combination with a pull-out component and an associated housing, for assisting the opening and closing movement of the pull-out component relative to the housing with an integrated damping mechanism, said housing having a slide member coupled to an interior wall thereof, and said pull-out component being linearly slidable into and out of said housing, the system comprising:

a first bracket coupled to said slide member of the housing;

a second bracket coupled proximate a rear end of said pull-out component;

a strut having a first end coupled to the first bracket and an opposing second end coupled to the second bracket, said strut comprising:

an outer straight hollow member having opposing first and second ends;

a first spring having opposing first and second ends and being housed within said straight hollow member; and a cylindrical piston having first, second, and third longitudinal portions, wherein the first longitudinal portion extends axially through the spring's second end, the second longitudinal portion extends axially outside of the spring's second end, and the third longitudinal portion extends from the second longitudinal portion in a direction opposite that of the first longitudinal portion so as to translate axially through said second end of the outer straight hollow member, said second longitudinal portion having a larger diameter than said first and third longitudinal portions; and a damping mechanism contained entirely within said strut and including a damper that counteracts the force exerted by the first spring on the cylindrical piston to dampen the movement of the pull-out component from a neutral region towards a fully-open position and from the neutral region towards a fully-closed position;

wherein the pull-out component is a drawer having a rear panel at a rear end thereof, and the piston's third longitudinal portion receives a drawer bracket clevis at a free end thereof;

wherein the second bracket includes a horizontal section and a clevis pin extending vertically downwards from an undersurface of said horizontal section, and wherein the drawer bracket clevis includes a clamshell coupling portion configured to releasably engage said second bracket's clevis pin; and wherein the drawer bracket clevis further includes opposing elastic handle members such that, when the handle members are pressed toward each other, the clamshell opens to receive said clevis pin.

22. The system of claim 21, wherein the first bracket includes a lower horizontal surface and a clevis pin extending vertically upwards from said lower horizontal surface.

23. The system of claim 22, wherein said housing is a cabinet, and said slide member is a cabinet slide member.

24. The system of claim 23, wherein the strut further includes a cabinet bracket clevis, said cabinet bracket clevis being coupled to said first end of the outer hollow member.

25. The system of claim 24, wherein the cabinet bracket clevis includes a coupling member to engage the first bracket's clevis pin.

26. The system of claim 25, wherein the coupling member is substantially fork-shaped and has opposing elastic fingers configured to releasably engage the first bracket's clevis pin.

27. The system of claim 25, wherein the coupling member is substantially C-shaped, and the first bracket's clevis pin is configured to releasably snap into said coupling member.

28. The system of claim 25, wherein the coupling member is configured to pivot about the clevis pin during linear opening and closing movement of the pull-out component.

29. The system of claim 25, wherein the first bracket's lower horizontal surface is configured to be coupled to the cabinet slide member.

30. A system, in combination with a pull-out component and an associated housing, for assisting the opening and closing movement of the pull-out component relative to the housing with an integrated damping mechanism, said housing having a slide member coupled to an interior wall thereof, and said pull-out component being linearly slidable into and out of said housing, the system comprising:

a first bracket coupled to said slide member of the housing;

a second bracket coupled proximate a rear end of said pull-out component;

a strut having a first end coupled to the first bracket and an opposing second end coupled to the second bracket, said strut comprising:

an outer straight hollow member having opposing first and second ends;

a first spring having opposing first and second ends and being housed within said straight hollow member; and a cylindrical piston having first, second, and third longitudinal portions, wherein the first longitudinal portion extends axially through the spring's second end, the second longitudinal portion extends axially outside of the spring's second end, and the third longitudinal portion extends from the second longitudinal portion in a direction opposite that of the first longitudinal portion so as to translate axially through said second end of the outer straight hollow member, said second longitudinal portion having a larger diameter than said first and third longitudinal portions; and a damping mechanism contained entirely within said strut and including a damper that counteracts the force exerted by the first spring on the cylindrical piston to dampen the movement of the pull-out component from a neutral region towards a fully-open position and from the neutral region towards a fully-closed position, wherein the damper includes an axial shaft and is housed within said third longitudinal portion of the cylindrical piston, and wherein the damping mechanism further includes:

an inner hollow member that extends from the first end of said strut and axially through said first spring, said inner hollow member being configured to slide at least partially through, and with respect to, said cylindrical piston; and a second spring that is housed in said inner hollow member between the first end of said strut and a spring seat slidably coupled to said damper axial shaft.

31. The system of claim 29, wherein said housing is a cabinet, the first bracket includes a clevis pin, the strut further includes a cabinet bracket clevis coupled to said first end of the outer hollow member and having a coupling member to detachably engage said clevis pin, said first end of the first spring is disposed on an opposite portion of the cabinet bracket clevis opposite said coupling member, and on said opposite portion of the cabinet bracket clevis, the cabinet bracket clevis includes a longitudinal stud that detachably couples said inner hollow member to said cabinet bracket clevis.

32. The system of claim 30, wherein said second spring is a compression spring.

33. The system of claim 30, wherein said spring seat is a cold head feature.

34. The system of claim 30, wherein said spring seat is a machined feature.

35. The system of claim 30, wherein said spring seat is a formed fastener.

36. The system of claim 30, said inner hollow member having opposing first and second ends, wherein said first end substantially coincides with the strut's first end, and wherein the damping mechanism further includes a cap defining an axial opening therethrough and being coupled to said second end of the inner hollow member.

37. The system of claim 36, wherein the spring seat is configured such that the spring seat does not pass through the axial opening in the inner hollow member's cap.

38. The system of claim 37, wherein, proximate a free end of the damper shaft, the damper shaft includes a radial indentation that engages the spring seat, thereby preventing further withdrawal of the shaft through the spring seat and towards the strut's second end.

39. The system of claim 38, wherein the second spring is configured such that, once the spring seat has been engaged by the damper shaft, as the first spring expands further and the cylindrical piston slides through the strut's second end, an end of the damper shaft opposite said free end is pulled out of the damper, thereby damping the piston's continued outward movement.

40. The system of claim 30, wherein the damping mechanism is configured such that, when the strut moves from a fully-extended position, in which the pull-out component is either fully open or fully closed, to a fully-retracted position, in which the pull-out component is in said neutral region, the damper shaft retracts first, and wherein, when the strut moves from the fully-retracted position to the fully-extended position, the damper shaft is extended last.

* * * * *